US011042103B2

(12) United States Patent
Aruga et al.

(10) Patent No.: US 11,042,103 B2
(45) Date of Patent: Jun. 22, 2021

(54) IMAGE FORMING APPARATUS HAVING OPTICAL PRINT HEAD

(71) Applicant: CANON KABUSHIKI KAISHA, Tokyo (JP)

(72) Inventors: Daisuke Aruga, Abiko (JP); Toshiki Momoka, Tokyo (JP); Takehiro Ishidate, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/460,276

(22) Filed: Jul. 2, 2019

(65) Prior Publication Data

US 2020/0019084 A1 Jan. 16, 2020

(30) Foreign Application Priority Data

Jul. 12, 2018 (JP) ..... JP2018-132659

(51) Int. Cl.
*G03G 15/04* (2006.01)
*G03G 21/16* (2006.01)
*G03G 15/043* (2006.01)

(52) U.S. Cl.
CPC ..... *G03G 15/04036* (2013.01); *G03G 15/043* (2013.01); *G03G 21/1652* (2013.01)

(58) Field of Classification Search
CPC ..... G03G 15/04036; G03G 21/1652; G03G 15/043
See application file for complete search history.

(56) References Cited

U.S. PATENT DOCUMENTS 8,879,950 B2 * 11/2014 Sato ..... G03G 21/1633 399/110
8,897,950 B2 * 11/2014 Roberts ..... G06F 7/00 340/438
9,304,477 B2 * 4/2016 Sone ..... G03G 15/80
(Continued)

FOREIGN PATENT DOCUMENTS

JP 2013-134370 A 7/2013
JP 2015-205497 A 11/2015
JP 2018-157358 * 10/2018 ..... G03G 21/1652

OTHER PUBLICATIONS

Machine translation of JP 2018-157358, published on Oct. 2018 (Year: 2018).*

*Primary Examiner* — Huan H Tran
(74) *Attorney, Agent, or Firm* — Canon U.S.A., Inc. I.P. Division

(57) ABSTRACT

An image forming apparatus includes a photosensitive drum to rotate as to an apparatus main body, a print head having a connector and a light emitting element, a movement mechanism to move the print head between an exposing position and a retracted position, a support part rotatable and to support the movement mechanism, a cable, and an abutting portion. The cable supplies drive signals for driving the light emitting element to the print head. The cable extends toward an opposite side of the connector and is bent toward one direction or another direction of the support part. The abutting portion is provided to the support part, and abuts the cable bent portion in a direction from the retracted position toward the exposing position to cause the cable to flex between a connected portion to the connector and the bent portion, when the print head is at the retracted position.

20 Claims, 20 Drawing Sheets

(56) References Cited

U.S. PATENT DOCUMENTS

| | | | | |
|---|---|---|---|---|
| 10,178,264 | B2 | 1/2019 | Harada | |
| 2018/0364608 | A1* | 12/2018 | Momoka | G03G 15/087 |
| 2018/0364609 | A1* | 12/2018 | Ishidate | G03G 15/04036 |
| 2018/0364610 | A1* | 12/2018 | Okada | G03G 15/04036 |
| 2018/0364611 | A1* | 12/2018 | Gokyu | G03G 21/1647 |
| 2018/0364612 | A1 | 12/2018 | Ishidate | |
| 2018/0364613 | A1* | 12/2018 | Momoka | G03G 21/1647 |
| 2018/0364614 | A1 | 12/2018 | Aruga | |
| 2018/0364636 | A1* | 12/2018 | Imai | G03G 15/04036 |
| 2019/0346809 | A1* | 11/2019 | Iwai | G03G 21/1666 |
| 2020/0019083 | A1 | 1/2020 | Ishidate | |

* cited by examiner

FIG. 9A1
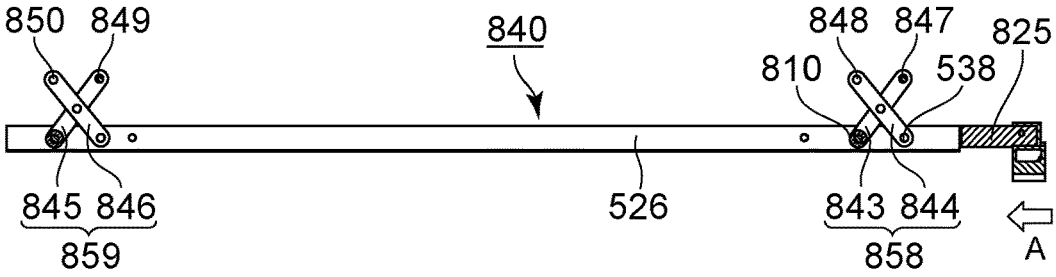
FIG. 9A2
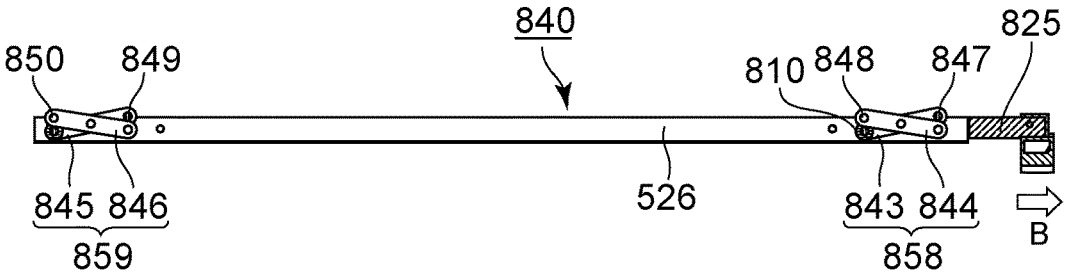
FIG. 9B
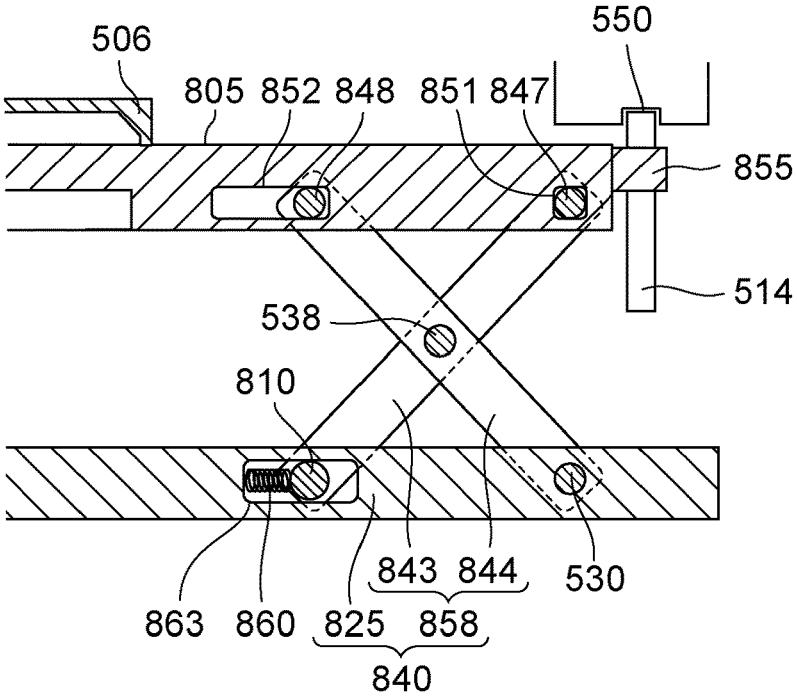

IMAGE FORMING APPARATUS HAVING OPTICAL PRINT HEAD

BACKGROUND

Field

The present disclosure relates to an image forming apparatus having an optical print head that is detachably mountable, by being inserted/extracted to/from an apparatus main body.

Description of the Related Art

There are image forming apparatuses, such as printers, photocopiers, and so forth, that have an optical print head having multiple light emitting elements for exposing a photosensitive drum. Some optical print heads use light-emitting diodes (LEDs), organic light-emitting diodes (OLEDs), or the like, as examples of light emitting elements. There are known arrangements where multiple such light emitting elements are arrayed in one row, or in two staggered rows, for example, along the rotational axis direction of the photosensitive drum. The optical print head also has multiple lenses for condensing light emitted from the multiple light emitting elements on the photosensitive drum. The multiple lenses are placed between the multiple light emitting elements and the photosensitive drum, so as to face the surface of the photosensitive drum along the direction of array of the light emitting elements.

Now, the multiple light emitting elements provided to the optical print head emit light in response to drive signals from a control unit provided in the image forming apparatus. Drive signals from the control unit are sent to the optical print head via a cable. Japanese Patent Laid-Open No. 2015-205497 describes using a flexible flat cable (FFC) to supply electric power from the control unit to an exposing unit that has light emitting elements such as LEDs or the like. Japanese Patent Laid-Open No. 2015-205497 also discloses a method of attaching a support bar (support part) having an exposing unit to an image forming apparatus, and a method of detaching the support bar from the image forming apparatus.

The exposing unit in Japanese Patent Laid-Open No. 2015-205497 is supported by the support bar formed of sheet metal, for example. When the support bar (support part) is in a state of being attached to the apparatus main body, the support bar (support part) is supported by a support plate. The support plate is fixed to the main body of the apparatus. A control board that controls driving of the exposing unit is also provided to the main body of the apparatus. The control board and the exposing unit are electrically connected by cable. Part of the cable is affixed to the support plate, thereby restricting movement in the direction in which the support bar (support part) moves.

In Japanese Patent Laid-Open No. 2015-205497, in a state where the support bar (support part) is accommodated in the main body of the apparatus, the cable has a curved portion of flexing in a U-shape from the rear side of the main body of the apparatus toward the front side (or from the front side toward the rear side) between the support bar (support part) and the support plate. When replacing the exposing unit for maintenance, a worker draws the support bar (support part), located at a mounting position, out to the front side by an amount corresponding to the amount of flexing in the flexing region of the cable, via an opening formed in a front-side plate. The worker then removes the cable from a connector provided to the exposing unit on the rear side of the front-side plate. Thereafter, the worker draws out the support bar (support part) toward the front side, and performs maintenance of the exposing unit, such as replacing the exposing unit with a new one, or the like.

The photosensitive drum also is periodically replaced, since it is a consumable item. The worker performs maintenance of the image forming apparatus by replacing a drum unit that includes the photosensitive drum. The drum unit is extracted from and inserted into a side face of the main body of the image forming apparatus, by sliding movement as to the main body of the apparatus. The clearance between the lenses and surface of the photosensitive drum is extremely small at an exposing position (position facing the surface of the drum in close proximity), which is the position of the optical print head when exposing the photosensitive drum. Accordingly, the optical print head and photosensitive drum or the like may come into contact and damage the surface of the photosensitive drum and lenses, unless the optical print head is retracted from the exposing position when replacing the drum unit. Thus, this may be addressed by the image forming apparatus having a mechanism where the optical print head is reciprocally moved between the exposing position and a retracted position of being retracted away from the photosensitive drum, from the exposing position.

Japanese Patent Laid-Open No. 2013-134370 discloses a movement mechanism that moves the optical print head between the exposing position and retracted position. A sliding member moves by sliding as to the main body of the apparatus, in conjunction with opening/closing actions of a front cover of the main body of the apparatus in Japanese Patent Laid-Open No. 2013-134370. The optical print head moves between the exposing position and retracted position in conjunction with the sliding movement of the sliding member. That is to say, the optical print head moves between the exposing position and retracted position in accordance with a worker opening and closing the front cover.

In a case where the exposing unit in Japanese Patent Laid-Open No. 2015-205497 is configured to move between the exposing position and retracted position as in Japanese Patent Laid-Open No. 2013-134370, a region of the cable between the portion connected to the connector and the portion bent toward the front side below the support bar (support part) also moves in conjunction with this movement. When the exposing unit is in a state of being situated at the retracted position, the amount of this region that is exposed downwards in the vertical direction from an opening formed in the support bar (support part) is greater as compared to a case of the exposing unit being situated at the exposing position. Accordingly, there is increased possibility of this region coming into contact with the edge of the opening formed in the front-side plate, when the worker moves the support bar (support part) by sliding and the connector in a state with the cable connected thereto passes the opening formed in the front-side plate.

SUMMARY

According to an aspect of the present disclosure, an image forming apparatus includes a photosensitive drum configured to rotate as to an apparatus main body, a print head having a connector, and a light emitting element configured to emit light to expose the photosensitive drum to the emitted light, a movement mechanism configured to move the print head between an exposing position where the light emitting element emits the light and exposes the photosensitive drum, and a retracted position where the print head is retracted to a position farther away from the photosensitive drum than the exposing position, a support part configured to support the movement mechanism, wherein the support part is movable in a rotational axis direction of the photosensitive drum via an opening formed in a front-side plate provided to the front side of the apparatus main body, and wherein the support portion is movable between a mounted position where the print head is mounted to the apparatus main body, and a drawn-out position where the print head has been drawn out from the apparatus main body with the connector situated further to the front side from the opening, a cable configured to be connected to the connector and supply drive signals for driving the light emitting element to the print head, wherein the cable extends toward an opposite side of the connector from a side where the photosensitive drum is disposed, and is bent toward one direction or another direction of the support part in the rotational axis direction at an opposite side of the support part from a side where the photosensitive drum is disposed, and an abutting portion configured to be provided to the support part, and to abut the bent portion of the cable in a direction from the retracted position toward the exposing position to cause the cable to flex at a portion between a connected portion to the connector and the bent portion, in a case where the print head is situated at the retracted position.

Further features of the present disclosure will become apparent from the following description of exemplary embodiments with reference to the attached drawings.

BRIEF DESCRIPTION OF THE DRAWINGS

FIGS. 4A, 4B1-4B2, 4C1-4C2 are diagrams for describing a board and lens array.

FIGS. 9A1-9A2, 9B are diagrams for describing a moving mechanism according to another modification.

DESCRIPTION OF THE EMBODIMENTS

Embodiments for carrying out the present disclosure are described below with reference to the attached drawings. It should be noted, however, that components given in this description are only exemplary, and that the present disclosure is not restricted to just the embodiments given in this description.

First Embodiment

Image Forming Apparatus

Figure 1A:
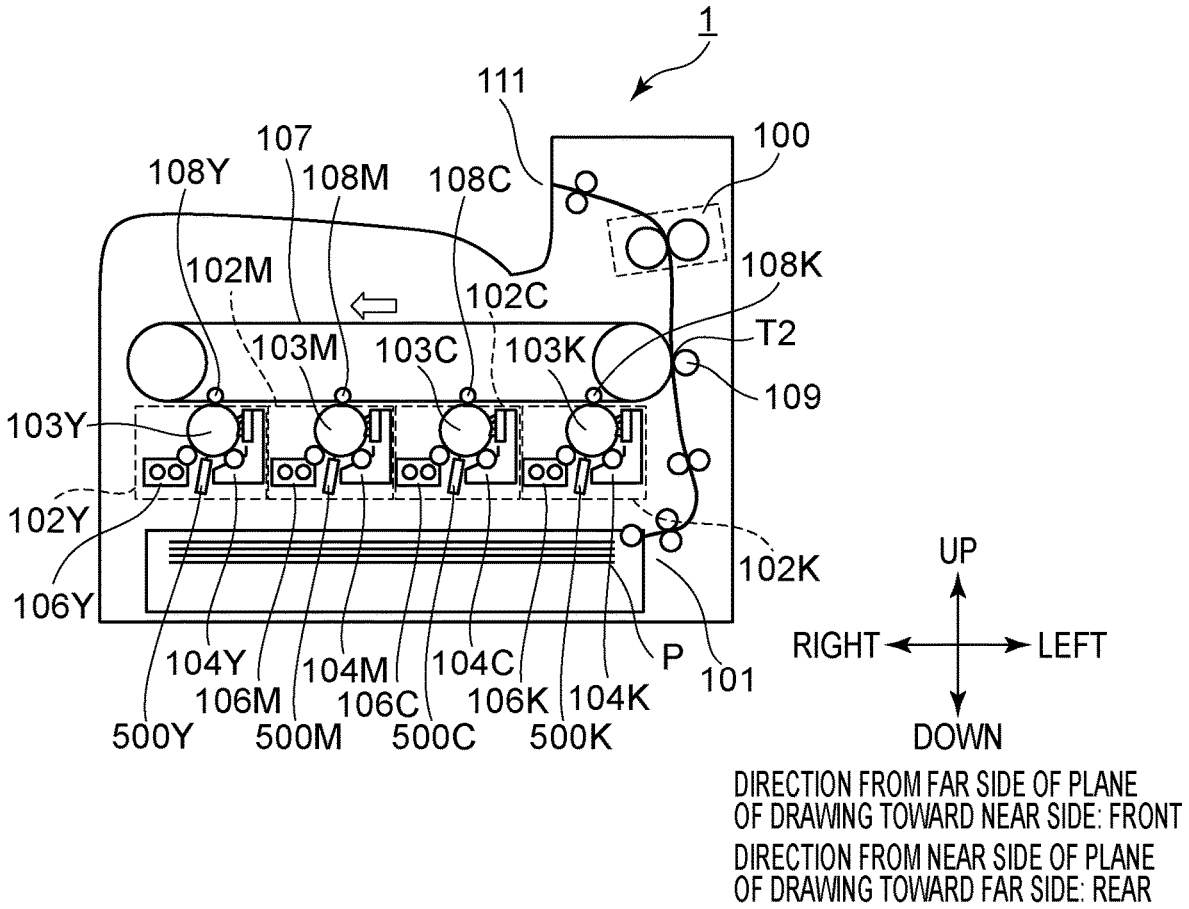
FIGS. 1A and 1B are diagrams for describing the configuration of an image forming apparatus.

First, a schematic configuration of an image forming apparatus 1 will be described. FIG. 1A is a schematic cross-sectional view of the image forming apparatus 1. Although the image forming apparatus 1 illustrated in FIG. 1A is a color printer (single function printer (SFP)) that does not have a reader, an embodiment may be a copying machine that has a reader. Also, an embodiment is not restricted to a color image forming apparatus having multiple photosensitive drums 103 as illustrated in FIG. 1A, and may be a color image forming apparatus having one photosensitive drum 103 or an image forming apparatus that forms monochromatic images.

The image forming apparatus 1 illustrated in FIG. 1A has four image forming units 102Y, 102M, 102C, and 102K (hereinafter also collectively referred to as "image forming unit 102") that form toner images of the yellow, magenta, cyan, and black colors. The image forming units 102Y, 102M, 102C, and 102K respectively have a photosensitive drum 103Y, 103M, 103C, and 103K (hereinafter also collectively referred to as "photosensitive drum 103"). The image forming units 102Y, 102M, 102C, and 102K also respectively have a charger 104Y, 104M, 104C, and 104K (hereinafter also collectively referred to as "charger 104") for charging the respective photosensitive drums 103Y, 103M, 103C, and 103K. The image forming units 102Y, 102M, 102C, and 102K further respectively have a light-emitting diode (LED) exposing unit 500Y, 500M, 500C, and 500K (hereinafter also collectively referred to as "exposing unit 500") serving as an exposure light source that emits light to expose the photosensitive drums 103Y, 103M, 103C, and 103K. Moreover, the image forming units 102Y, 102M, 102C, and 102K respectively have a developing unit 106Y, 106M, 106C, and 106K (hereinafter also collectively referred to as "developing unit 106") that develops electrostatic latent images on the photosensitive drum 103 by toner, thereby developing toner images of the respective colors on the photosensitive drums 103. Note that the Y, M, C, and K appended to the reference numerals indicate the color of the toner.

Figure 1B:
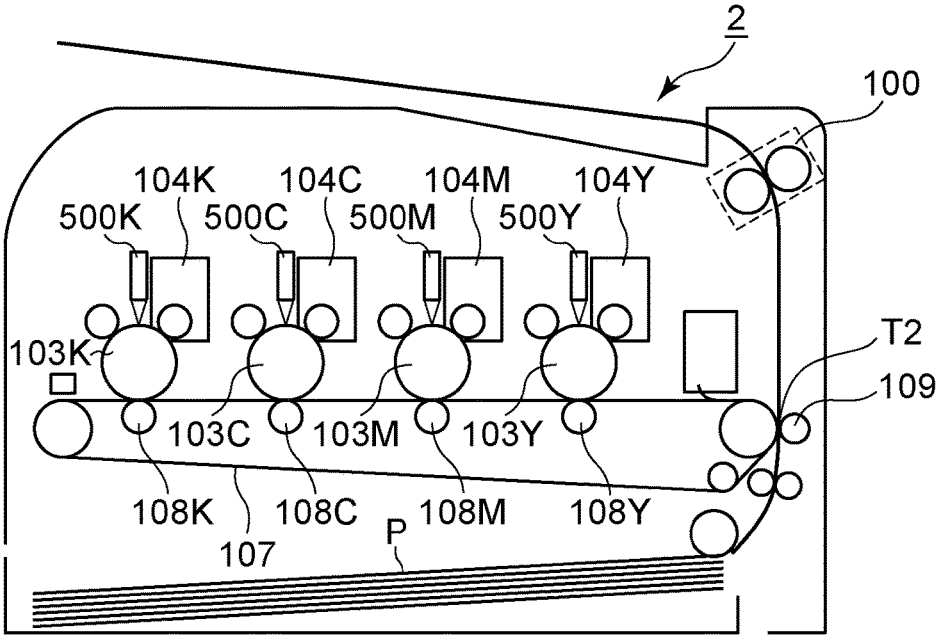

The image forming apparatus 1 illustrated in FIG. 1A is an image forming apparatus that employs what is called "bottom-side exposure", where the photosensitive drum 103 is exposed from below. Although description will be made below assuming an image forming apparatus employing bottom-side exposure, an embodiment may be made where the image forming apparatus employs "top-side exposure", where the photosensitive drum 103 is exposed from above, as in an image forming apparatus 2 illustrated in FIG. 1B. Portions in FIG. 1B that indicate the same configurations as those in FIG. 1A are denoted by the same reference symbols.

The image forming apparatus 1 is provided with an intermediate transfer belt 107 onto which toner images formed on the photosensitive drums 103 are transferred, and primary transfer roller 108 (Y, M, C, K) that sequentially transfer the toner images formed on the photosensitive drums 103 onto the intermediate transfer belt 107. The image forming apparatus 1 further is provided with a secondary transfer roller 109 that transfers the toner image on the intermediate transfer belt 107 onto a recording sheet P conveyed from a sheet feed unit 101, and a fixing unit 100 that fixes the secondary-transferred image onto the recording sheet P.

Image Forming Process

The exposing unit 500Y exposes the surface of the photosensitive drum 103Y that has been charged by the charger 104Y. Accordingly, an electrostatic latent image is formed on the photosensitive drum 103Y. Next, the developing unit 106Y develops the electrostatic latent image formed on the photosensitive drum 103Y by yellow toner. The yellow toner image developed on the surface of the photosensitive drum 103Y is transferred onto the intermediate transfer belt 107 by the primary transfer roller 108Y. Magenta, cyan, and black toner images are also transferred onto the intermediate transfer belt 107 by the same image forming process.

The toner images of each color transferred onto the intermediate transfer belt 107 are conveyed to a secondary transfer position T2 by the intermediate transfer belt 107. Transfer bias for transferring the toner images onto a recording sheet P is applied to the secondary transfer roller 109 disposed at the secondary transfer position T2. The toner images conveyed to the secondary transfer position T2 are transferred onto a recording sheet P conveyed from the sheet feed unit 101 by the transfer bias of the secondary transfer roller 109. The recording sheet P onto which the toner images have been transferred is conveyed to the fixing unit 100. The fixing unit 100 fixes the toner images onto the recording sheet P by heat and pressure. The recording sheet P subjected to fixing processing by the fixing unit 100 is discharged to a sheet discharge unit 111.

Drum Unit and Developing Unit

Drum units 518Y, 518M, 518C, and 518K (hereinafter collectively referred to as "drum unit 518") that have the photosensitive drum 103 are attached to the image forming apparatus 1. The drum unit 518 is a cartridge replaced by a worker such as the user, maintenance staff, or the like. The drum unit 518 rotatably supports the photosensitive drum 103. Specifically, the photosensitive drum 103 is rotatably supported by a frame of the drum unit 518. Note that the drum unit 518 may be a configuration that does not include the charger 104 or cleaning device.

Further attached to the image forming apparatus 1 according to the present embodiment are developing units 641Y, 641M, 641C, and 641K (hereinafter collectively referred to as "developing unit 641"), which are separate from the drum units 518. The developing units 641 according to the present embodiment are cartridges where the developing units 106 illustrated in FIG. 1A and toner containers have been integrated. Each developing unit 106 is provided with a developing sleeve (omitted from illustration) that bears toner. Each developing unit 641 is provided with multiple gears for rotating a screw that agitates the toner and a carrier. When these gears deteriorate due to age or the like, a worker removes the developing unit 641 from the apparatus main body of the image forming apparatus 1 and replaces it. Note that an embodiment of the drum unit 518 and developing unit 641 may be a process cartridge where the drum unit 518 and developing unit 641 are integrated.

Figure 2A:
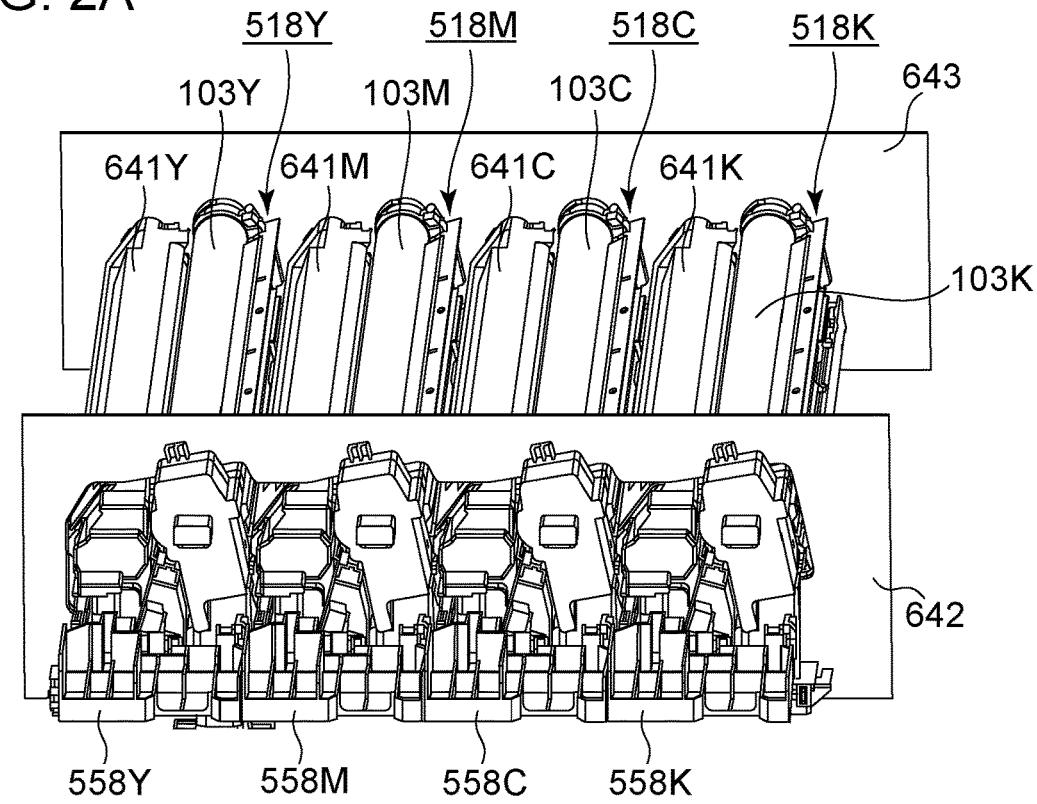
FIGS. 2A and 2B are diagrams illustrating around drum units and around developing units that the image forming apparatus has.
Figure 2B:
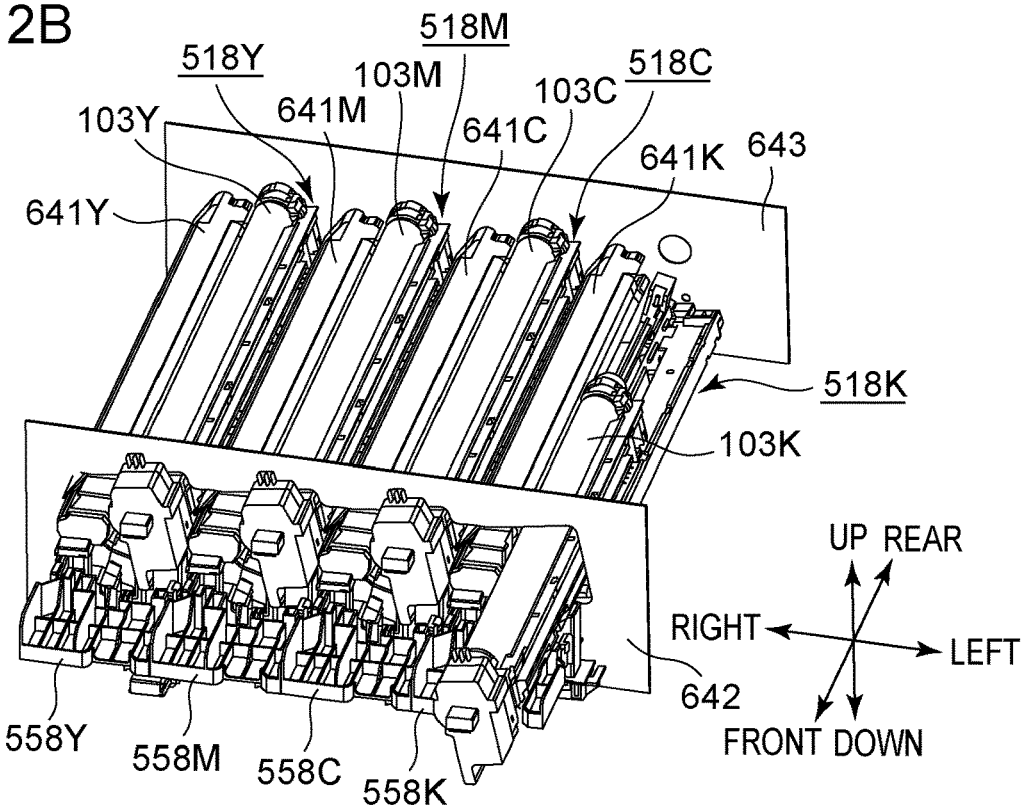

FIG. 2A is a perspective view illustrating the schematic configuration around the drum units 518 and around the developing units 641 that the image forming apparatus 1 has. FIG. 2B is a diagram illustrating a drum unit 518 being inserted into the image forming apparatus 1 from the outer side of the apparatus main body.

The image forming apparatus 1 has a front-side plate 642 formed from sheet metal, and a rear-side plate 643 similarly formed from sheet metal, as illustrated in FIG. 2A. The front-side plate 642 is a side wall provided to the front side of the image forming apparatus 1. The front-side plate 642 makes up part of the casing of the apparatus main body at the front side of the main body of the image forming apparatus 1. The rear-side plate 643 is a side wall provided to the rear side of the image forming apparatus 1. The rear-side plate 643 makes up part of the casing of the apparatus main body at the rear side of the main body of the image forming apparatus 1. The front-side plate 642 and rear-side plate 643 are disposed facing each other as illustrated in FIG. 2A, with sheet metal, serving as beams that are omitted from illustration, crossing therebetween. The front-side plate 642, rear-side plate 643, and unshown beams each make up part of a frame of the image forming apparatus 1.

Now, the front side or the front side regarding the image forming apparatus 1 according to the present embodiment or the components thereof is the side where the drum unit 518 is placed into or drawn out (insertion/extraction) of the apparatus main body. This also is the side where the user stands by the image forming apparatus 1 when performing operations thereof. The rear side or rear side is the opposite side from this.

Openings are formed in the front-side plate 642, through which the drum units 518 and developing units 641 can be inserted into and extracted from the front side of the image forming apparatus 1. The drum units 518 and developing units 641 are mounted through openings to predetermined positions in the main body of the image forming apparatus 1 (mounting positions). The image forming apparatus 1 also has covers 558Y, 558M, 558C, and 558K (hereinafter collectively referred to as "cover 558") that cover the front side of both the drum units 518 and developing units 641 mounted to the mounting positions. The covers 558 have one end thereof fixed integrally to the main body of the image forming apparatus 1 by a hinge, and are configured to execute pivoting as to the main body of the image forming apparatus 1 on the hinge. Replacement work is completed by a worker opening a cover 558 and extracting a drum unit 518 or developing unit 641 within the main body, inserting a new drum unit 518 or developing unit 641, and closing the cover 558.

In the following description, the front-side plate 642 side of the apparatus main body is defined as the front side (front side), and the rear-side plate 643 side as the rear side (rear side), as illustrated in FIGS. 2A and 2B here. Also, the side where the photosensitive drum 103Y that forms electrostatic latent images relating to yellow toner images is disposed is defined as the right side, with the photosensitive drum 103K that forms electrostatic latent images relating to black toner images as a reference. The side where the photosensitive drum 103K that forms electrostatic latent images relating to black toner images is disposed is defined as the left side, with the photosensitive drum 103Y that forms electrostatic latent images relating to yellow toner images as a reference. Further, a direction that is perpendicular to the front-and-rear directions and left-and-right directions defined here, and is upward in the vertical direction is defined as the upward direction, and a direction that is perpendicular to the front-and-rear directions and left-and-right directions defined here, and is downward in the vertical direction is defined as the downward direction. The defined front direction, rear direction, right direction, left direction, upward direction, and downward direction, as illustrated in FIGS. 2A and 2B. Further, the rotational axis direction of the photosensitive drum 103 as used herein is a direction that generally matches the front-and-rear directions illustrated in FIGS. 2A and 2B.

Exposing Unit

Next, the exposing unit 500 including the optical print head 105 (an example of a print head) will be described. An example of an exposing method employed in electrophotographic image forming apparatuses is laser-beam scanning exposure, where an irradiation beam of semiconductor laser is scanned using a rotating polygonal mirror or the like, and the photosensitive drum is exposed via an f-theta lens or the like. The "optical print head 105" described in the present embodiment is an arrangement used in the LED exposure method where the photosensitive drum 103 is exposed using light emitting elements such as LEDs or the like arrayed in the rotational axis direction of the photosensitive drum 103, and is not used in the aforementioned laser-beam scanning exposure.

Figure 3:
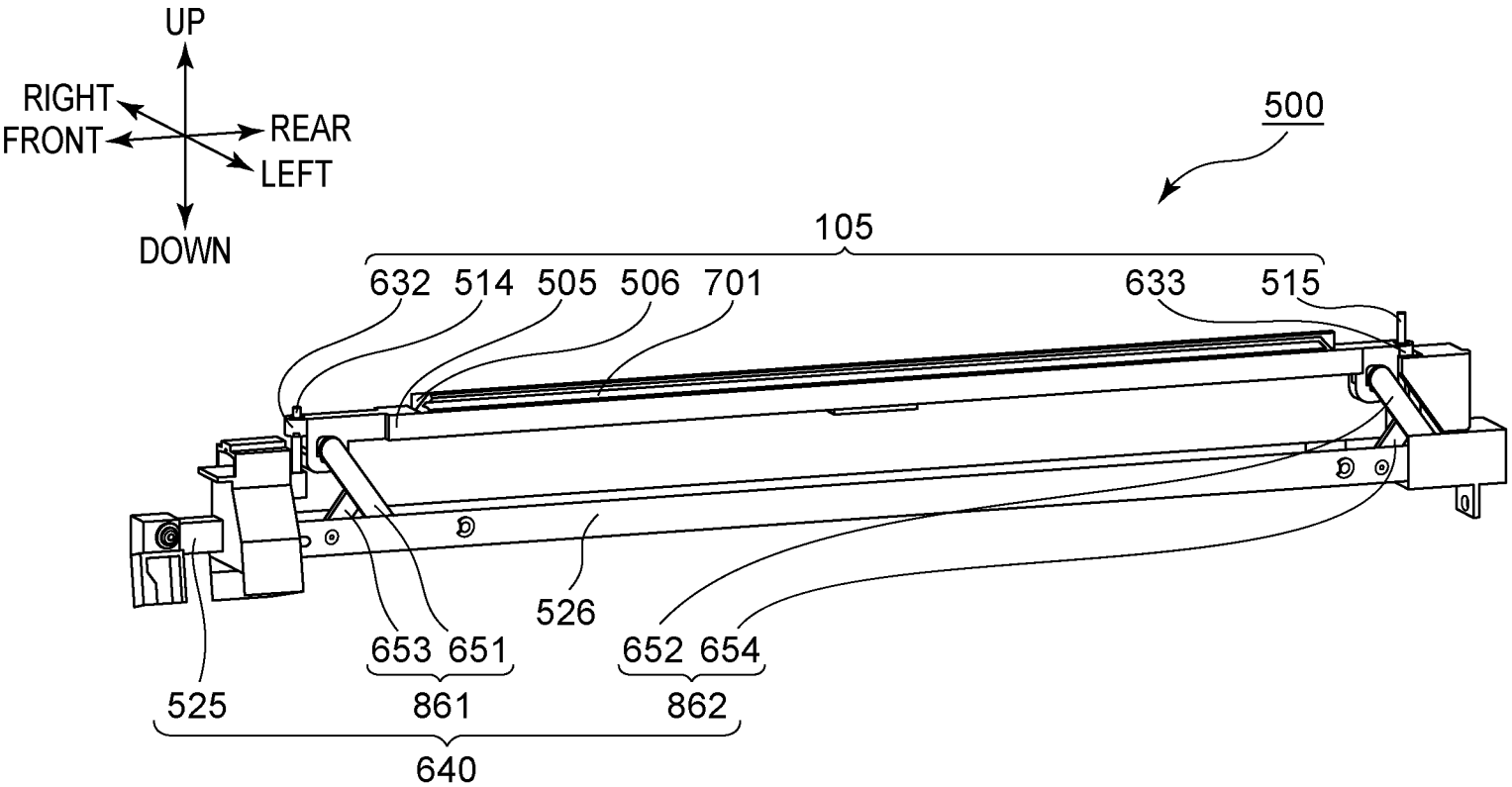
FIG. 3 is a diagram for describing the configuration of an optical print head.

The exposing unit 500 described in the present embodiment is disposed below the rotational axis of the photosensitive drum 103 in the vertical direction, and LEDs 503 that the optical print head 105 has expose the photosensitive drum 103 from beneath. Note however, a configuration may be made where the exposing unit 500 is disposed above the rotational axis of the photosensitive drum 103 in the vertical direction, and exposes the photosensitive drum 103 from above (see FIG. 1B). FIG. 3 is a schematic perspective view of the exposing unit 500 that the image forming apparatus 1 according to the present embodiment has.

The exposing unit 500 in FIG. 3 has the optical print head 105 and a movement mechanism 640. The optical print head 105 is provided with a lens array 506, a circuit board 502 (omitted from illustration in FIG. 3), a holding member 505, a first abutting pin 514, and a second abutting pin 515.

A gap is formed between the lens array 506 and the photosensitive drum 103 by the first abutting pin 514 and the second abutting pin 515 coming into contact with the drum unit 518, and the position of the optical print head 105 as to the photosensitive drum 103, when forming images, is determined. The movement mechanism 640 has a first link mechanism 861, a second link mechanism 862, and a sliding portion 525 (an example of a moving member). The first link mechanism 861 has a link member 651 and link member 653. The second link mechanism 862 has a link member 652 and link member 654. The sliding portion 525 moves by sliding in the front-and-rear directions, in conjunction with opening/closing operations of the cover 558 that is omitted from illustration in FIG. 3. The first link mechanism 861 and second link mechanism 862 are driven synchronously with the sliding movement of the sliding portion 525, and the optical print head 105 moves up and down. Detailed operations of the movement mechanism 640 will be described later. The portions of the frame of the drum unit 518 where the first abutting pin 514 and second abutting pin 515 abut are provided with fitting holes where the tips of the first abutting pin 514 and second abutting pin 515 fit in by around 5 mm, for example. Thus, the optical print head 105 is accurately positioned as to the photosensitive drum 103.

The holding member 505 will be described next in the description of the structure of the optical print head 105. The holding member 505 is a holder that holds the later-described circuit board 502 and lens array 506. Resin is employed as the material for the holding member 505 in the present embodiment, from the perspective of reducing weight and reducing costs of the optical print head 105 itself, but may be metal instead.

The exposing unit 500 is disposed below the rotational axis of the photosensitive drum 103 in the vertical direction, and the LEDs 503 that the optical print head 105 has expose the photosensitive drum 103 from beneath. Note that a configuration may be made where the exposing unit 500 is disposed above the rotational axis of the photosensitive drum 103 in the vertical direction, and the LEDs 503 that the optical print head 105 has expose the photosensitive drum 103 from above.

Figure 4A:
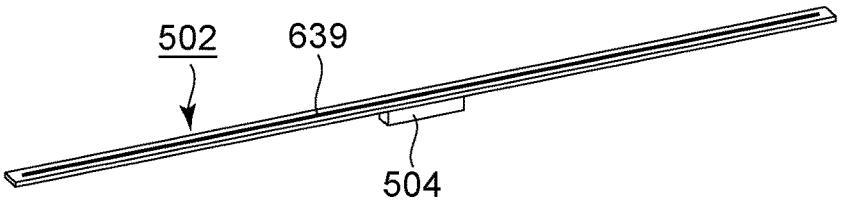
Figure 4A:
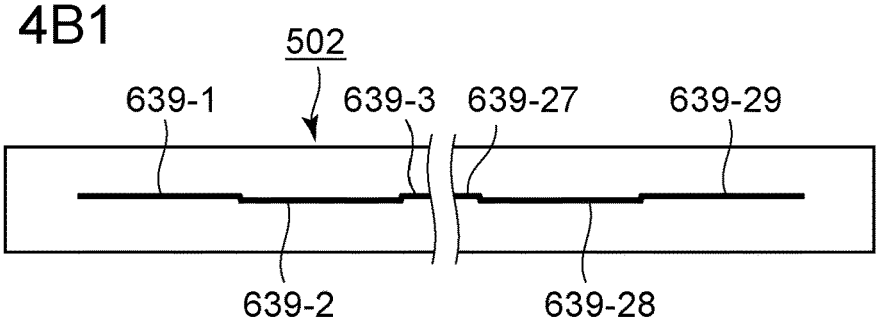
Figure 4A:
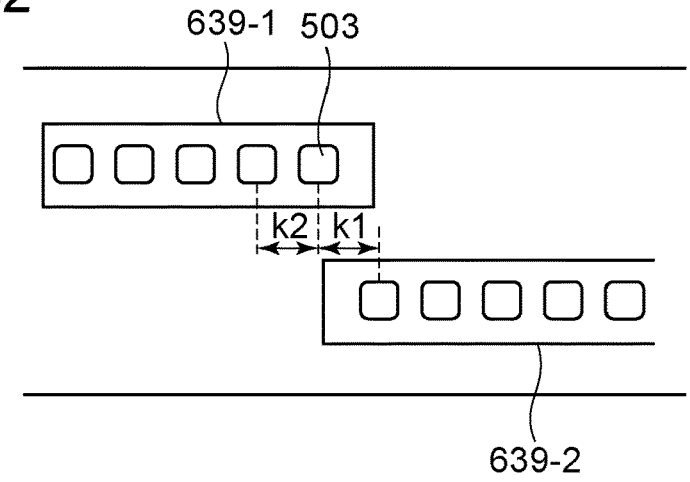
Figure 4A:
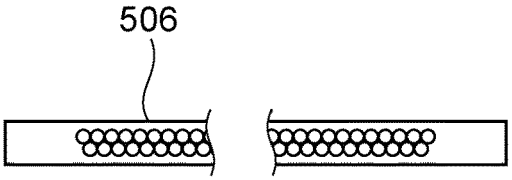
Figure 4A:
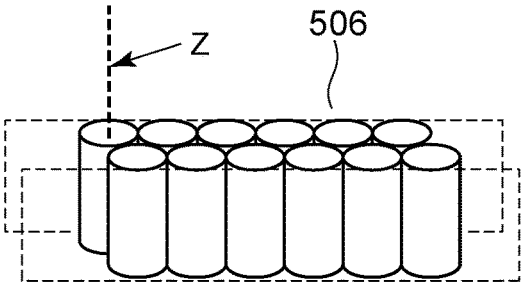

Next, the circuit board 502 held by the holding member 505 will be described. FIG. 4A is a schematic perspective view of the circuit board 502. FIG. 4B1 illustrates the array of the multiple LEDs 503 provided on the circuit board 502. FIG. 4B2 is an enlarged view of FIG. 4B1.

LED chips 639 are mounted on the circuit board 502. The LED chips 639 are mounted on one face of the circuit board 502, while a connector 504 is provided to the other face, as illustrated in FIG. 4A. The circuit board 502 is provided with wiring to supply signals to the LED chips 639. One end of a flexible flat cable (FFC) that is omitted from illustration is connected to the connector 504. A circuit board is provided to the main body of the image forming apparatus 1. The circuit board has a control unit and connector. The other end of the FFC is connected to this connector. Control signals are input to the circuit board 502 from the control unit of the main body of the image forming apparatus 1 via the FFC and connector 504. The LED chips 639 are driven by the control signals input to the circuit board 502.

The LED chips 639 mounted on the circuit board 502 will be described in further detail. Multiple (29) LED chips 639-1 through 639-29 are arrayed on one face of the circuit board 502, as illustrated in FIGS. 4B1 and 4B2. Each of the LED chips 639-1 through 639-29 has multiple LEDs that are examples of light-emitting elements arrayed in a single row in the longitudinal direction thereof. Each of the LED chips 639-1 through 639-29 has 516 LEDs. The center-to-center distance k2 between LEDs adjacent in the longitudinal direction in the LED chips 639 corresponds to the resolution of the image forming apparatus 1. The resolution of the image forming apparatus 1 according to the present embodiment is 1200 dpi, so the LEDs are arrayed in a single row so that the center-to-center distance k2 between adjacent LEDs in the longitudinal direction of the LED chips 639-1 through 639-29 is 21.16 μm. Accordingly, the range of exposure of the optical print head 105 according to the present embodiment is approximately 316 mm. The photosensitive layer of the photosensitive drum 103 is formed to be 316 mm or wider. The length of the long side of an A4-size recording sheet and the length of the short side of an A3-size recording sheet are 297 mm, so the optical print head 105 according to the present embodiment has an exposing range that executes forming images on A4-size recording sheets and A3-size recording sheets.

The LED chips 639-1 through 639-29 are alternately arrayed to form two rows in the rotational axis direction of the photosensitive drum 103. That is to say, odd-numbered LED chips 639-1, 639-3, and so on through 639-29, are arrayed on one line in the longitudinal direction of the circuit board 502 from the left, and even-numbered LED chips 639-2, 639-4, and so on through 639-28, are arrayed on one line in the longitudinal direction of the circuit board 502, as illustrated in FIG. 4B1. Arraying the LED chips 639 in this way allows the center-to-center distance k1 between the LEDs disposed on one end of one LED chip 639 and the other end of another LED chip 639 among different adjacent LED chips 639 to be equal to the center-to-center distance k2 of adjacent LEDs on the same LED chip 639, in the longitudinal direction of the LED chips 639, as illustrated in FIG. 4B2. An example where the exposing light source is configured using LEDs is described in the present embodiment. However, OLEDs may be used instead as the exposing light source.

Next, the lens array 506 will be described. FIG. 4C1 is a schematic diagram viewing the lens array 506 from the photosensitive drum 103 side. FIG. 4C2 is a schematic perspective view of the lens array 506. These multiple lenses are arrayed in two rows following the direction of array of the multiple LEDs 503, as illustrated in FIG. 4C1. The lenses are disposed in a staggered manner such that each lens in one row comes into contact with two lenses in the other row that are adjacent in the direction of array of the lenses. The lenses are cylindrical glass rod lenses. Note that the material of the lenses is not restricted to glass, and that plastic may be used. The shape of the lenses is not restricted to a cylindrical shape either, and may be polygonal posts such as hexagonal posts or the like, for example.

A dotted line Z in FIG. 4C2 indicates the optical axis of a lens. The optical print head 105 is moved by the above-described movement mechanism 640 in a direction generally following the optical axis of the lens indicated by the dotted line Z. The term optical axis of a lens here means a line that connects the center of the light emitting face of the lens and the focal point of this lens. The discharged light emitted from an LED enters a lens included in the lens array 506. The lens functions to condense the discharged light entering the lens onto the surface of the photosensitive drum 103. The attachment position of the lens array 506 as to a lens attaching portion, omitted from illustration, is adjusted when assembling the optical print head 105, such that the distance between the light-emitting face of the LED and incoming light face of the lens, and the distance between the light-emitting face of the lens and the surface of the photosensitive drum 103, are generally equal.

Movement Mechanism

The movement mechanism 640 that moves the optical print head 105 between the exposing position and the retracted position will be described. The movement mechanism 640 reciprocally moves the optical print head 105 between the exposing position and the retracted position, which will be described below. The movement mechanism 640 has the first link mechanism 861, the second link mechanism 862, the sliding portion 525, and a first support portion 526, as illustrated in FIG. 3. The first link mechanism 861 includes the link member 651 and link member 653, and the second link mechanism 862 includes the link member 652 and link member 654. The link member 651 and link member 653, and the link member 652 and link member 654, each make up a λ-type link mechanism, as illustrated in FIG. 3.

Figure 5A:
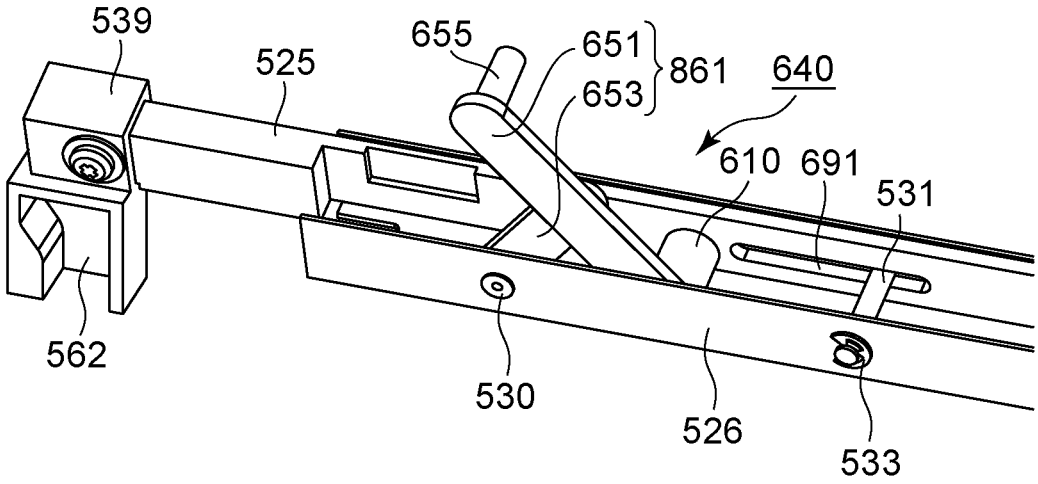
FIGS. 5A and 5B are diagrams for describing a moving mechanism and a first support member.
Figure 5B:
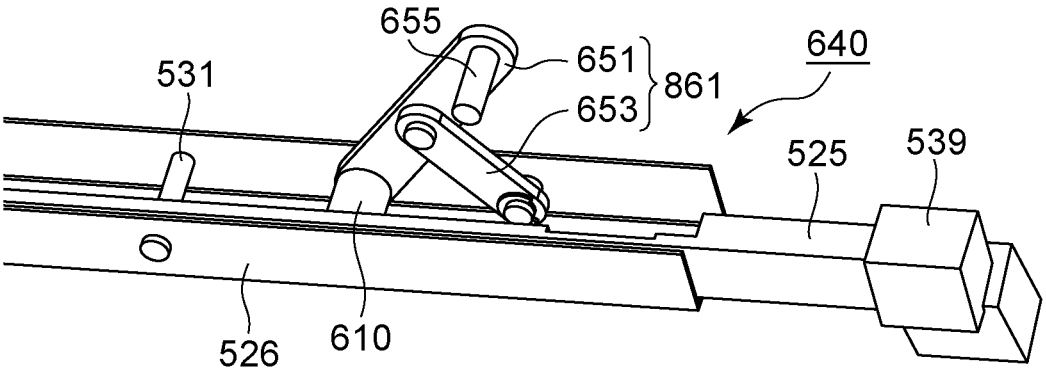

FIG. 5A is a schematic perspective view of the front side of the movement mechanism 640, as viewed from the left side. FIG. 5B is a schematic perspective view of the front side of the movement mechanism 640, as viewed from the right side.

Figure 6A:
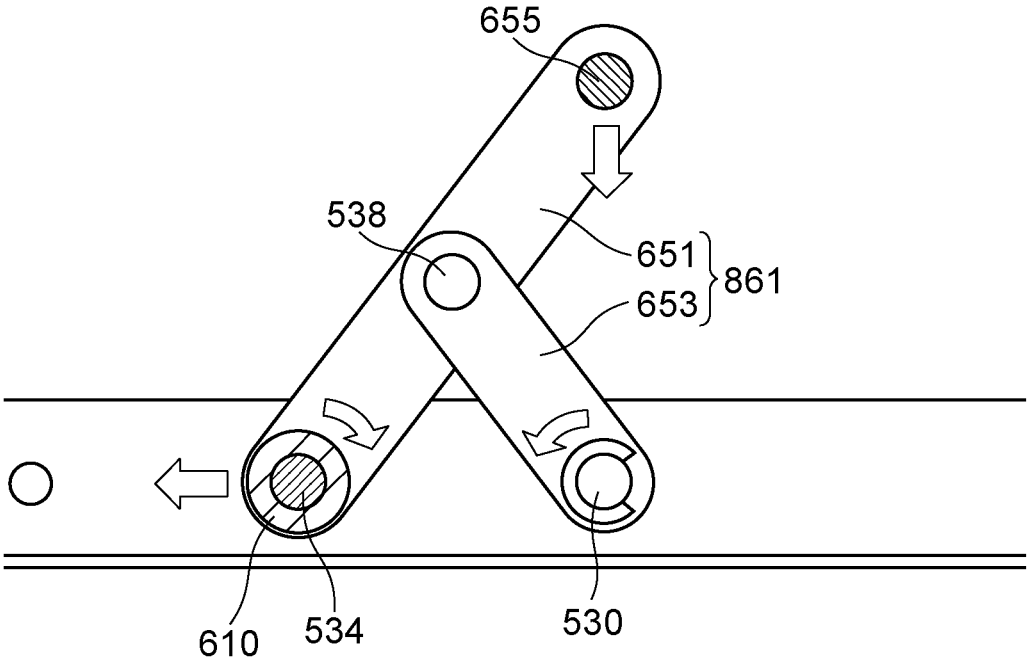
FIGS. 6A and 6B are diagrams for describing a link mechanism that the moving mechanism has.
Figure 6B:
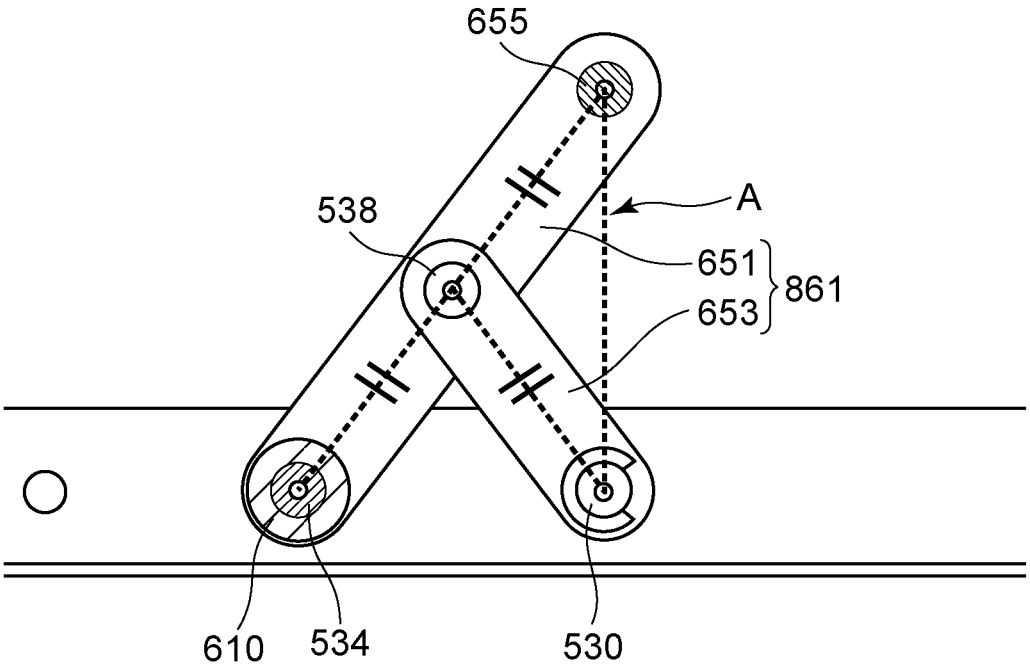

The first link mechanism 861 will be described with reference to FIGS. 5A through 6B. FIG. 6A is a diagram where a cross-sectional view of the first link mechanism 861 taken along the rotational axis of the photosensitive drum 103 is viewed from the right side. The first link mechanism 861 has the link member 651 and link member 653. The link member 651 and link member 653 making up the first link mechanism 861 are each single link members, but may be configured by combining multiple link members. The length of the link member 653 in the longitudinal direction is shorter than the length of the link member 651 in the longitudinal direction, as illustrated in FIGS. 6A and 6B.

The link member 651 has a bearing 610, a protrusion 655, and a connecting shaft portion 538. The bearing 610 is provided to one end side in the longitudinal direction of the link member 651. The protrusion 655 is a cylindrical protrusion erected in the pivoting axis direction of the link member 651 provided at the other end side in the longitudinal direction of the link member 651, for causing deformation of a spring provided to the holding member 505 side of the optical print head 105. The connecting shaft portion 538 is provided between the bearing 610 and protrusion 655 in the longitudinal direction of the link member 651. Although the protrusion 655 serves as a first moving portion, the first moving portion is not restricted to the protrusion 655, and may be a structure where one end side in the longitudinal direction of the link member 651 is bent in the pivoting axis direction.

A circular hollowed space that extends in the left-and-right direction in FIG. 6A is formed in the bearing 610, as a hole. A fitting shaft portion 534 is provided to the sliding portion 525. The fitting shaft portion 534 is a cylindrical protrusion erected from the sliding portion 525 to the left direction in FIG. 6A. The fitting shaft portion 534 forms a first connecting portion by being pivotably fit to the hole of the bearing 610. That is to say, the link member 651 is configured to pivot as to the sliding portion 525, with the first connecting portion as the center of pivoting. Note that the fitting shaft portion 534 may be formed on the link member 651 side, and the bearing 610 formed on the sliding portion 525.

The link member 653 has a connecting shaft portion 530. The connecting shaft portion 530 is provided to one end side in the longitudinal direction of the link member 653. The connecting shaft portion 530 is a cylindrical protrusion erected from the link member 653 to the left side in FIG. 6A. The connecting shaft portion 530 is rotatably inserted into a hole formed in the first support portion 526, and thus forms a third connecting portion. Now, the connecting shaft portion 530 may be formed to the first support portion 526 rather than the link member 653. That is to say, the connecting shaft portion 530 formed on the first support portion 526 may be inserted to a hole formed in the link member 653.

A circular hole that extends in the left-and-right direction in FIG. 6A is formed at the other end side in the longitudinal direction of the link member 653. The connecting shaft portion 538 of the link member 651 is pivotably inserted into this hole, whereby the connecting shaft portion 538 and the hole of the link member 653 make up of a fourth connecting portion. That is to say, the link member 653 is configured to pivot as to the first support portion 526 with the third connecting portion as a center of pivoting, and is configured to pivot as to the link member 651 with the fourth connecting portion as a center of pivoting. Now, the connecting shaft portion 538 may be formed on the link member 653 rather than the link member 651. That is to say, the connecting shaft portion 538 formed on the link member 653 may be inserted into a hole formed in the link member 651.

Note that the configuration of the second link mechanism 862 is the same as the configuration of the first link mechanism 861 described above. The link member 652 and link member 654 that the second link mechanism 862 has correspond to the link member 651 and link member 653, respectively. The one end side in the longitudinal direction of the link member 652 and the connecting portion of the sliding portion 525 make up a second connecting portion, corresponding to the first connecting portion. Note that one of the link member 653 and link member 654 may be omitted from the embodiment regarding the movement mechanism 640.

According to the above configuration, when the sliding portion 525 moves by sliding from the front side toward the rear side with regard to the first support portion 526, the bearing 610 to which the fitting shaft portion 534 has been fit moves by sliding from the front side toward the rear side as to the first support portion 526, along with the sliding portion 525. Accordingly, when viewing the first link mechanism 861 from the right side as illustrated in FIG. 6A, the link member 651 pivots in the clockwise direction with the fitting shaft portion 534 as the center of pivoting, and the link member 653 pivots in the counter-clockwise direction with the connecting shaft portion 530 as the center of pivoting. Accordingly, the protrusion 655 moves in a direction from the exposing position toward the retracted position.

On the other hand, when the sliding portion 525 moves by sliding from the rear side toward the front side as to the first support portion 526, the link member 651 and link member 653 move in the opposite directions as to the arrows in FIG. 6A. When the sliding portion 525 moves by sliding from the rear side toward the front side with regard to the first support portion 526, the bearing 610 to which the fitting shaft portion 534 has been fit moves by sliding from the rear side toward the front side as to the first support portion 526, along with the sliding portion 525. Accordingly, when viewing the first link mechanism 861 from the right side as illustrated in FIG. 6A, the link member 651 pivots in the counter-clockwise direction with the fitting shaft portion 534 as the center of pivoting, and the link member 653 pivots in the clockwise direction with the connecting shaft portion 530 as the center of pivoting. Accordingly, the protrusion 655 moves in a direction from the retracted position toward the exposing position.

Now, (1) the distance between the pivoting center axis of the connecting shaft portion 538 and the pivoting center axis of the bearing 610 will be referred to as L1, (2) the distance between the pivoting center axis of the connecting shaft portion 538 and the pivoting center axis of the connecting shaft portion 530 will be referred to as L2, and (3) the distance between the pivoting center axis of the connecting shaft portion 538 and the pivoting center axis of the protrusion 655 will be referred to as L3. In the movement mechanism 640, the first link mechanism 861 forms a Scott Russel linkage where L1, L2, and L3 are equal (see FIG. 6B). The protrusion 655 moves perpendicular (along dotted line A in FIG. 6B) to the direction of sliding movement of the fitting shaft portion 534 due to the distances L1, L2, and L3 being equal, so the optical print head 105 can be moved generally in the optical axis direction of the lens in the above-described link mechanism.

Now, a configuration may be made where the front-and-rear directions of the first link mechanism 861 and second link mechanism 862 are opposite, so that when the sliding portion 525 is moved by sliding from the front side toward the rear side, the optical print head 105 moves from the retracted position toward the exposing position, and when the sliding portion 525 is moved by sliding from the rear side toward the front side, the optical print head 105 moves from the exposing position toward the retracted position. In this case, the later-described cover 558 presses the sliding portion 525 from the front side toward the rear side when moving from an opened state to a closed state, and draws the sliding portion 525 out from the rear side toward the front side when moving from a closed state to an opened state.

The mechanism for moving optical print head 105 is not restricted to the movement mechanism 640. A movement mechanism 140 illustrated in FIGS. 7A and 7B may be used. The movement mechanism 140 will be described below with reference to FIGS. 7A through 8B. Note that members which have substantially the same functions as the members making up the movement mechanism 640 are denoted by the same reference numerals, and redundant description may be omitted.

The arrangement by which the movement mechanism 140 moves the holding member 505 will be described below with reference to FIGS. 7A through 8B. FIG. 8A is a cross-sectional view of the holding member 505 and the movement mechanism 140 illustrated in FIG. 8B, taken along the rotational axis of the photosensitive drum 103.

Figure 7A:
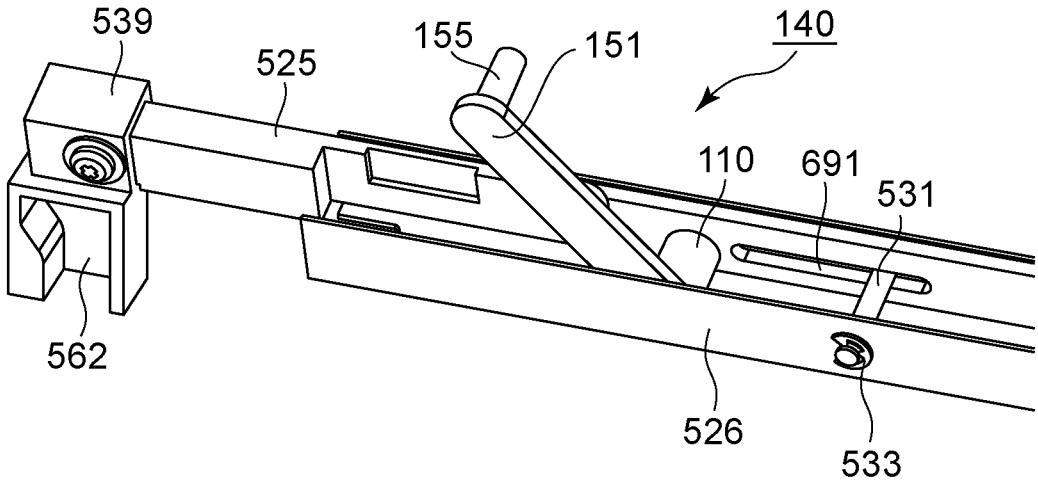
FIGS. 7A and 7B are diagrams for describing the configuration of a moving mechanism according to a modification.
Figure 7B:
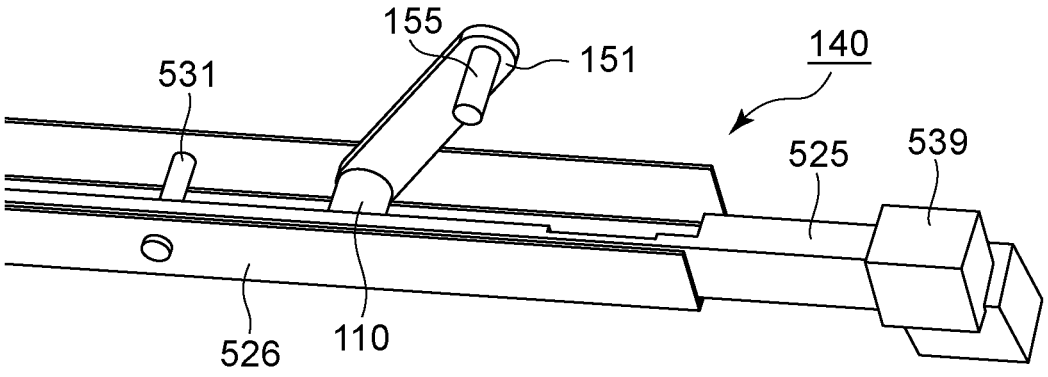
Figure 8A:
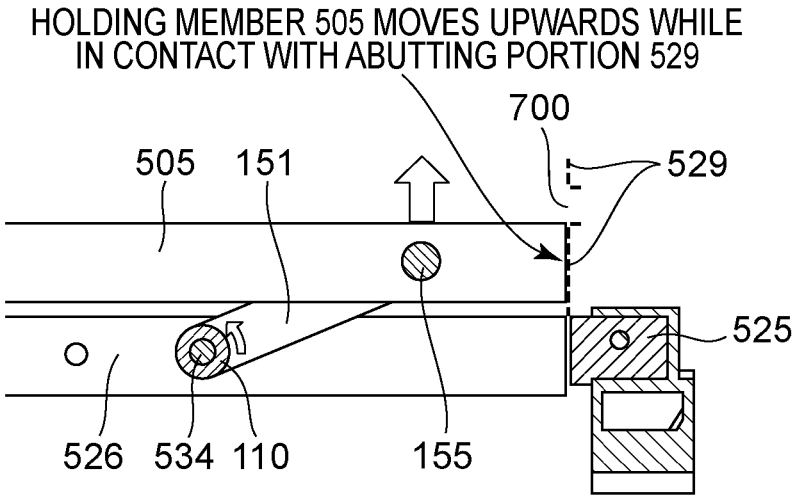
FIGS. 8A and 8B are diagrams for describing operations of the moving mechanism according to the modification.
Figure 8B:
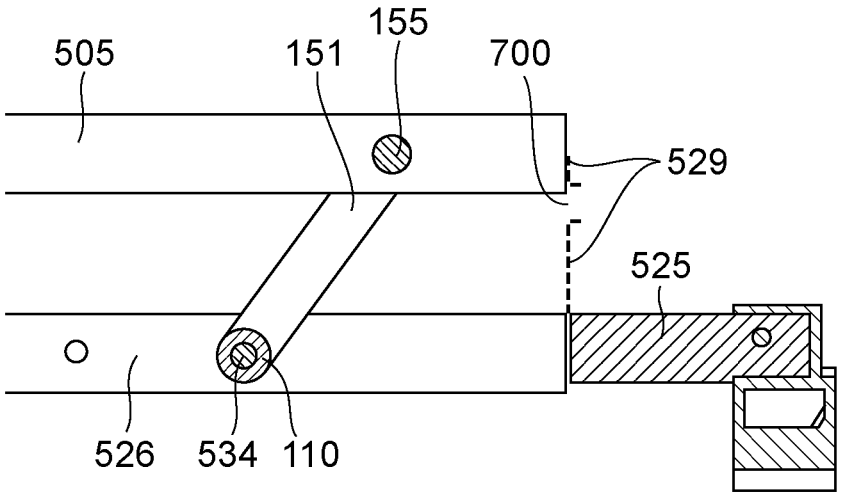

The link member 151 has a bearing 110 and a protrusion 155, as illustrated in FIGS. 7A and 7B. The bearing 110 is provided at the one end side of the link member 151 in the longitudinal direction. The protrusion 155 is, as illustrated in FIGS. 8A and 8B, a cylindrical protrusion that is provided on the other end side of the link member 151 in the longitudinal direction and that is erected in the pivoting axis direction of the link member 151. The protrusion 155 is a protrusion for deforming a spring provided on the holding member 505 side of the optical print head 105. Note that the first moving portion is not restricted to being the protrusion 155, and may be a structure where the one end side in the longitudinal direction of the link member 151 is bent in the pivoting axis direction of the link member 151.

A circular hollowed space that extends in the left-and-right direction is formed in the bearing 110, as a hole. A fitting shaft portion 534 is provided to the sliding portion 525, as illustrated in FIGS. 8A and 8B. The fitting shaft portion 534 is a cylindrical protrusion erected from the sliding portion 525 toward the left. The hole of the bearing 110 is fit with the fitting shaft portion 534 so as to be configured to pivot, thereby forming a first connecting portion. That is to say, the link member 151 is pivotable as to the sliding portion 525, with the first connecting portion as the center of pivoting. Note that an arrangement may be made where the fitting shaft portion 534 is formed on the link member 151 side, and the bearing 110 is formed on the sliding portion 525.

Note that a shaft the same as the support shaft 531 is provided at the rear side of the first support portion 526, a slot the same as the slot 691 is formed at the rear side of the sliding portion 525, and the structure of the rear side of the movement mechanism 140 is the same as the front side. The structure of the link member 152 also is the same as the structure of the first moving member described above, with the link member 152 corresponding to the link member 151. The connecting portion of the one end side in the longitudinal direction of the link member 152 and the sliding portion 525 make up the second connecting portion, corresponding to the first connecting portion.

The abutting portion 529 that faces the holding member 505 in the direction of sliding movement of the sliding portion 525 is disposed further toward the front side as compared to the one end of the holding member 505. Accordingly, when the sliding portion 525 moves by sliding as to the first support portion 526 from the rear side to the front side, the bearing 110 to which the fitting shaft portion 534 is fit also moves by sliding as to the first support portion 526 from the rear side to the front side, along with the sliding portion 525. The holding member 505 to which the protrusion 155 is attached also attempts to move toward the front side in conjunction with this, but the one end of the holding member 505 is abutting the abutting portion 529, and accordingly movement toward the front side is restricted. The link member 151 is disposed intersecting the rotational axis direction of the photosensitive drum 103 such that the one end side having the protrusion 155 is situated closer to the drum unit 518 side as compared to the other end side having the bearing 110, and accordingly pivots in a counterclockwise direction with the fitting shaft portion 534 as the center of pivoting, as viewed from the right side as illustrated in FIG. 8A. Accordingly, the holding member 505 moves from the retracted position toward the exposing position with the one end of the holding member 505 abutting the abutting portion 529.

On the other hand, when the sliding portion 525 moves by sliding as to the first support portion 526 from the front side to the rear side, the bearing 110 fit to the fitting shaft portion 534 moves by sliding as to the first support portion 526 from the rear side to the front side, along with the sliding portion 525. Accordingly, the link member 151 pivots in a clockwise direction with the fitting shaft portion 534 as the center of pivoting, as viewed from the right side as illustrated in FIG. 8A. Thus, the protrusion 155 moves in a direction from the exposing position toward the retracted position. The sliding portion 525 moves from the rear side to the front side in conjunction with a closing operation of the cover 558, and moves from the front side to the rear side in conjunction with an opening operation of the cover 558, which will be described in detail later. That is to say, when the cover 558 moves from an opened state to a closed state, the holding member 505 moves in a direction from the retracted position toward the exposing position, and when the cover 558 moves from the closed state to the opened state, the holding member 505 moves in a direction from the exposing position toward the retracted position.

Note that the link member 151 and link member 152 may be arranged such that the other end side is situated further toward the front side than the one end side, with the abutting portion 529 situated further toward the rear side than the other end of the holding member 505. That is to say, when the sliding portion 525 moves by sliding as to the first support portion 526 from the front side to the rear side, the bearing 110 to which the fitting shaft portion 534 is fit also moves by sliding as to the first support portion 526 from the front side to the rear side, along with the sliding portion 525. The holding member 505 to which the protrusion 155 is attached also attempts to move to the rear side in conjunction with this, but the other end of the holding member 505 is abutting the abutting portion 529, and accordingly movement toward the rear side is restricted. Accordingly, the link member 151 and link member 152 pivot in the clockwise direction as to the sliding portion 525 when viewing the link member 151 from the right side, and the holding member 505 moves from the retracted position toward the exposing position with the other end of the holding member 505 abutting the abutting portion 529. In this case, the cover 558 presses the sliding portion 525 from the front side toward the rear side when moving from the opened state to the closed state, and draws the sliding portion 525 out from the rear side toward the front side when moving from the closed state to the opened state.

The mechanism for moving the optical print head 105 is not restricted to the movement mechanism 140 and movement mechanism 640. A movement mechanism 840 illustrated in FIGS. 9A1 through 9B may be used. The movement mechanism 840 will be described below with reference to FIGS. 9A1 through 9B. Note that members having substantially the same functions as members making up the movement mechanism 140 (840) are described being denoted by the same reference numerals, and redundant description may be omitted.

FIGS. 9A1 and 9A2 illustrate the movement mechanism 840. The movement mechanism 840 includes a first link mechanism 858, a second link mechanism 859, sliding portion 825, and the first support portion 526, as illustrated in FIGS. 9A1 and 9A2. The first link mechanism 858 includes a link member 843 and a link member 844, and the second link mechanism 859 includes a link member 845 and a link member 846. The link member 843 and link member 844, and the link member 845 and link member 846, each pivotably intersect each other, making up an X-shaped link mechanism as illustrated in FIGS. 9A1 through 9B. A protrusion 847 of the link member 843, a protrusion 848 of the link member 844, a protrusion 849 of the link member 845, and a protrusion 850 of the link member 846, are each pivotably attached to a holding member 805 that is omitted from illustration. When a sliding portion 825 is moved by sliding in the direction of the arrow A in FIG. 9A1, the link members 843 through 846 pivot with regard to the sliding portion 825, and the protrusions 847 through 850 move downwards (FIG. 9A2). On the other hand, when the sliding portion 825 is moved by sliding in the direction of the arrow B in FIG. 9A2, the link members 843 through 846 pivot with regard to the sliding portion 825, and the protrusions 847 through 850 move upwards (FIG. 9A1).

FIG. 9B is a diagram illustrating the front side of the movement mechanism 840 with the front side of the holding member 805. The arrangement by which the movement mechanism 840 moves the holding member 805 will be described below with reference to FIG. 9B. Now, the operations of the first link mechanism 858 and second link mechanism 859 are substantially the same, so the first link mechanism 858 will be described here with reference to FIG. 9B. The first link mechanism 858 has the link member 843 and link member 844. The link member 843 and link member 844 making up the first link mechanism 858 are each single members, but may be configured by combining multiple link members.

The movement mechanism 840 in FIG. 9B has the first link mechanism 858 and sliding portion 825. The sliding portion 825 has a slot 863 that is an elongated opening, passing through the sliding portion 825 in the left-and-right direction and extending in the front-and-rear direction, as illustrated in FIG. 9B.

The link member 843 has a protrusion 810, the protrusion 847, and the connecting shaft portion 538. The protrusion 810 is provided to one end side in the longitudinal direction of the link member 843. The protrusion 847 is a cylindrical protrusion erected to the right side in the pivoting axial direction of the link member 843, provided to the other end side in the longitudinal direction of the link member 843.

The connecting shaft portion 538 is provided between the protrusion 810 and protrusion 847 in the longitudinal direction of the link member 843. Although the protrusion 847 serves as a first moving portion, the first moving portion is not restricted to the protrusion 847, and may be a structure where one end side in the longitudinal direction of the link member 843 is bent in the pivoting axis direction.

The protrusion 810 is pivotably loosely fit to the slot 863 of the sliding portion 825, thereby forming the first connecting portion. That is to say, the link member 843 is pivotable as to the sliding portion 825 with the first connecting portion as the center of pivoting. The protrusion 810 also is configured to move in the front-and-rear direction within the range of the slot 863 in the front-and-rear direction (within the opening). A coil spring 860 is disposed between the rear-side edge of the slot 863 and the protrusion 810.

The link member 844 has the connecting shaft portion 530 and the protrusion 848. The connecting shaft portion 530 is provided to one end side in the longitudinal direction of the link member 844. The connecting shaft portion 530 is a cylindrical protrusion erected from the link member 844 to the right side in FIG. 9B. The connecting shaft portion 530 is pivotably inserted into a hole formed in the first support portion 526, thereby forming the third connecting portion. Now, the connecting shaft portion 530 may be formed on the first support portion 526 rather than the link member 844. That is to say, the connecting shaft portion 530 formed on the first support portion 526 may be inserted into a hole formed in the link member 844.

The protrusion 848 is a cylindrical protrusion provided to the other end side in the longitudinal direction of the link member 844, erected to the right side in the pivoting axis direction of the link member 844. A circular hole that extends in the left-and-right direction in FIG. 9B is formed between the protrusion 848 of the link member 844 and the third connecting portion. The connecting shaft portion 538 of the link member 843 is pivotably inserted into this hole, whereby the connecting shaft portion 538 and the hole of the link member 844 make up the fourth connecting portion. That is to say, the link member 844 is configured to pivot as to the first support portion 526 with the third connecting portion as a center of pivoting, and is configured to pivot as to the link member 843 with the fourth connecting portion as a center of pivoting. Now, the connecting shaft portion 538 may be formed on the link member 844 rather than the link member 843. That is to say, the connecting shaft portion 538 formed on the link member 844 may be inserted into a hole formed in the link member 843. Note that one of the link member 843 and link member 844 may be omitted from the embodiment regarding the movement mechanism 840.

The holding member 805 has the lens array 506, a link attaching portion 851, a link attaching portion 852, and a pin attaching portion 855. The link attaching portion 851 and link attaching portion 852 both are provided between pins 514 attached to the lens array 506 and holding member 805. Although omitted from illustration, a link attaching portion 853 and link attaching portion 854 to which the link member 845 and link member 846 making up the second link mechanism 859 are attached are both provided between pins 515 attached to the other end side of the lens array 506 and holding member 805. The link attaching portion 851 is a hole formed to the holding member 805 between the lens array 506 and pin attaching portion 855, passing through in the left-and-right direction. The link attaching portion 852 is a slot that is formed in the holding member 805 between the lens array 506 and the link attaching portion 851, and that passes through in the left-and-right direction and extends in the front-and-rear direction.

The protrusion 847 of the link member 843 is pivotably attached to the link attaching portion 851, and the protrusion 848 of the link member 844 is pivotably attached to the link attaching portion 852. The protrusion 848 is attached to the link attaching portion 851 so as to be configured to move in the front-and-rear direction. Accordingly, the link member 844 is configured to move by sliding in the front-and-rear direction within the range of the link attaching portion 852 in the front-and-rear direction, while pivoting with the protrusion 848 as a center of pivoting.

According to the above-described configuration, when the sliding portion 825 moves by sliding from the front side to the rear side as to the first support portion 526, the protrusion 810 moves by sliding from the front side to the rear side as to the first support portion 526 along with the sliding portion 825. Accordingly, when viewing the first link mechanism 858 from the right side as illustrated in FIG. 9A1, the protrusion 848 moves from the front side to the rear side at the link attaching portion 852 with the link member 843 pivoting clockwise with the protrusion 810 as the center of pivoting and the link member 844 pivoting counter-clockwise with the connecting shaft portion 530 as the center of pivoting. Accordingly, the protrusion 847 and protrusion 848 move in the direction from the exposing position toward the retracted position.

On the other hand, when the sliding portion 825 moves by sliding from the rear side to the front side as to the first support portion 526, the protrusion 810 moves by sliding from the rear side to the front side as to the first support portion 526 along with the sliding portion 825. Accordingly, when viewing the first link mechanism 858 from the right side as illustrated in FIG. 9A2, the protrusion 848 moves from the rear side to the front side at the link attaching portion 852 with the link member 843 pivoting counter-clockwise with the protrusion 810 as the center of pivoting and the link member 844 pivoting clockwise with the connecting shaft portion 530 as the center of pivoting. Accordingly, the protrusion 847 and protrusion 848 move from the retracted position toward the exposing position. When the sliding portion 825 further moves by sliding to the front side in a state where the abutting pin 514 is in contact with an abutting face 550, as illustrated in FIG. 9B, the coil spring 860 is compressed between the rear side edge of the slot 863 and the protrusion 810. The protrusion 810 is biased to the front side by the restoration force of the compressed coil spring 860. Accordingly, biasing force heading upwards is applied to the holding member 805.

Now, a configuration may be made where the front-and-rear directions of the first link mechanism 858 and second link mechanism 859 are opposite, so that when the sliding portion 825 is moved by sliding from the front side toward the rear side, the optical print head 105 moves from the retracted position toward the exposing position, and when the sliding portion 825 is moved by sliding from the rear side toward the front side, the optical print head 105 moves from the exposing position toward the retracted position. In this case, the later-described cover 558 presses the sliding portion 825 from the front side toward the rear side when moving from an opened state to a closed state, and draws the sliding portion 825 out from the rear side toward the front side when moving from a closed state to an opened state.

The mechanism for moving the optical print head 105 is not restricted to the movement mechanism 140, movement mechanism 640, and movement mechanism 840. A movement mechanism 940 illustrated in FIGS. 10A and 10B may be used. The movement mechanism 940 will be described below with reference to FIGS. 10A and 10B. Note that members having substantially the same functions as members making up the movement mechanism 140 (including 640 and 840) are described being denoted by the same reference numerals, and redundant description may be omitted.

Figure 10A:
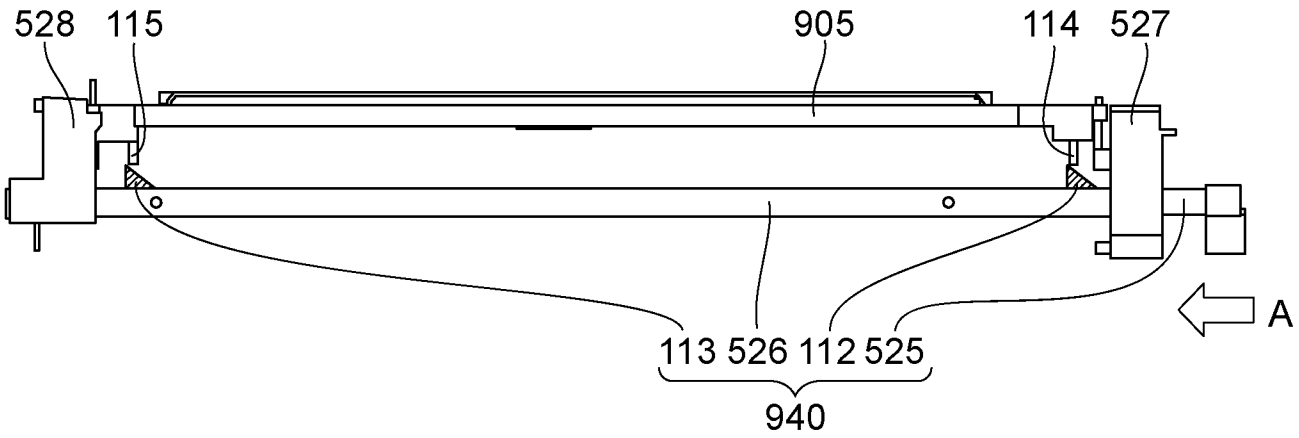
FIGS. 10A and 10B are diagrams for describing a moving mechanism using a cam mechanism.
Figure 10B:
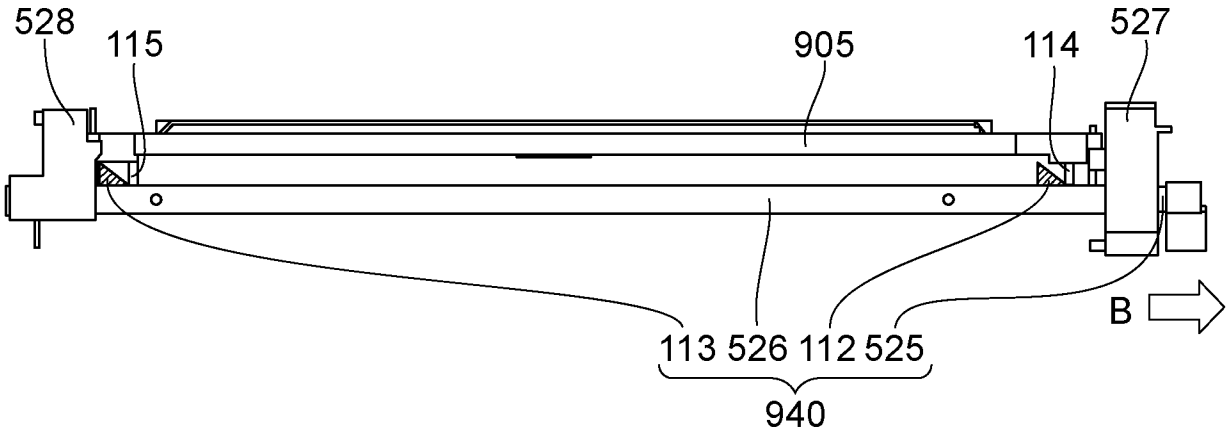

As illustrated in FIGS. 10A and 10B, a first cam portion 112 and a second cam portion 113 are provided to the front side and rear side of the sliding portion 525. A movement support portion 114 and a movement support portion 115 are provided to the front side and rear side at the lower side of the holding member 905. The first cam portion 112 and second cam portion 113 have a face inclined downwards from the rear side toward the front side as to the holding member 905 side.

FIG. 10A is a schematic diagram illustrating the optical print head 105 situated at the exposing position and the movement mechanism 940, as viewed from the right side. When the sliding portion 525 moves by sliding from the front side to the rear side as to the first support portion 526 in a case where the optical print head 105 is at the exposing position, the first cam portion 112 and second cam portion 113 provided to the sliding portion 525 move by sliding from the front side to the rear side as to the first support portion 526, along with the sliding portion 525. Accordingly, the lower ends of the movement support portion 114 and movement support portion 115 provided to the holding member 905 abut the first cam portion 112 and second cam portion 113, and the movement support portion 114 and movement support portion 115 move along the first cam portion 112 and second cam portion 113 in a direction from the exposing position toward the retracted position.

FIG. 10B is a schematic diagram illustrating the optical print head 105 situated at the retracted position and the movement mechanism 940, as viewed from the right side. When the sliding portion 525 moves by sliding from the rear side to the front side as to the first support portion 526 in a case where the optical print head 105 is at the retracted position, the first cam portion 112 and second cam portion 113 provided to the sliding portion 525 move by sliding from the rear side to the front side as to the first support portion 526, along with the sliding portion 525. Accordingly, the lower ends of the movement support portion 114 and movement support portion 115 provided to the holding member 905 are pressed upwards and move along the first cam portion 112 and second cam portion 113 in a direction from the retracted position toward the exposing position.

Now a structure may be made where the direction of inclination of the inclined faces that the first cam portion 112 and second cam portion 113 respectively have is a downwards inclination from the front side toward the rear side, with sliding movement of the sliding portion 525 from the front side to the rear side moving the optical print head 105 from the retracted position toward the exposing position, and sliding movement of the sliding portion 525 from the rear side to the front side moving the optical print head 105 from the exposing position toward the retracted position. In this case, the later-described cover 558 presses the sliding portion 525 from the front side toward the rear side when moving from an opened state to a closed state, and draws the sliding portion 525 out from the rear side toward the front side when moving from a closed state to an opened state.

Figure 11:
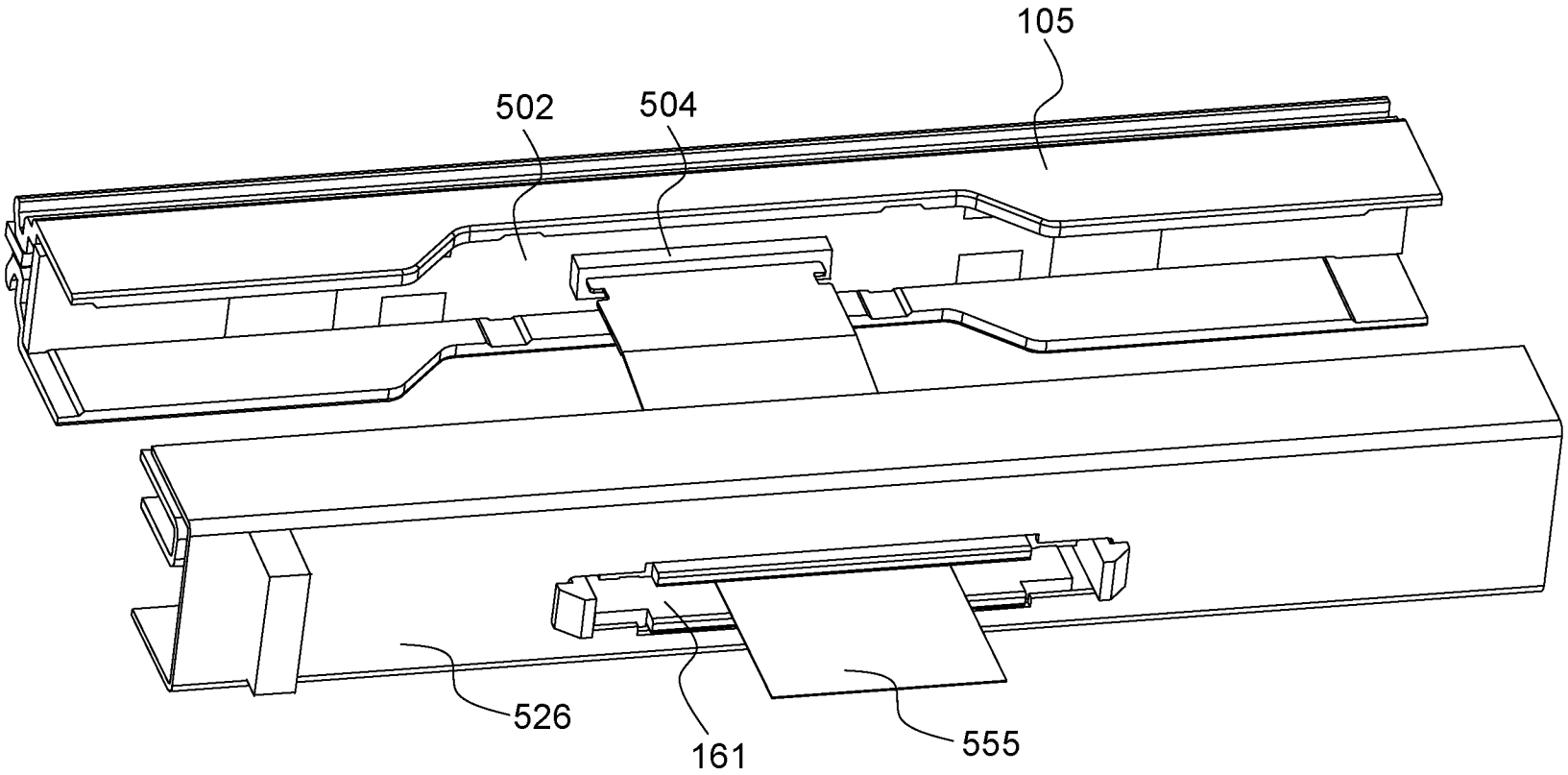
FIG. 11 is a diagram for describing an opening formed in the first support member.

FIG. 11 is a diagram for describing an opening 161 formed in the first support portion 526 (example of a support portion). The opening 161 that is a through hole passing through the first support portion 526 is formed in the first support portion 526, as described earlier. The opening 161 is formed in the bottom face, which is the face of the first support portion 526 that is at the lower side in the vertical direction in a state where the first support portion 526 is attached to the image forming apparatus 1. The opening 161 also is formed in the part of the first support portion 526 that faces the connector 504 of the circuit board 502. In further detail, the opening 161 is formed in the first support portion 526 so as to overlap the connector 504 in the direction of movement of the moving optical print head 105 between the exposing position and the retracted position by the movement mechanism 640. That is to say, in a state where the optical print head 105 is mounted to the apparatus main body of the image forming apparatus 1, the opening 161 formed on the first support portion 526 is situated below the connector 504 in the vertical direction. The opening 161 is a rectangular hole in the present embodiment, with the long side thereof being 70 mm long, and the short side 10 mm long. A cable 555 connected to the connector 504 of the circuit board 502 that the optical print head 105 has is passed through the opening 161. The cable 555 extends from the connector 504 in the opposite direction from the side of the optical print head 105 where the photosensitive drum is situated, and passes through the opening 161.

Figure 12:
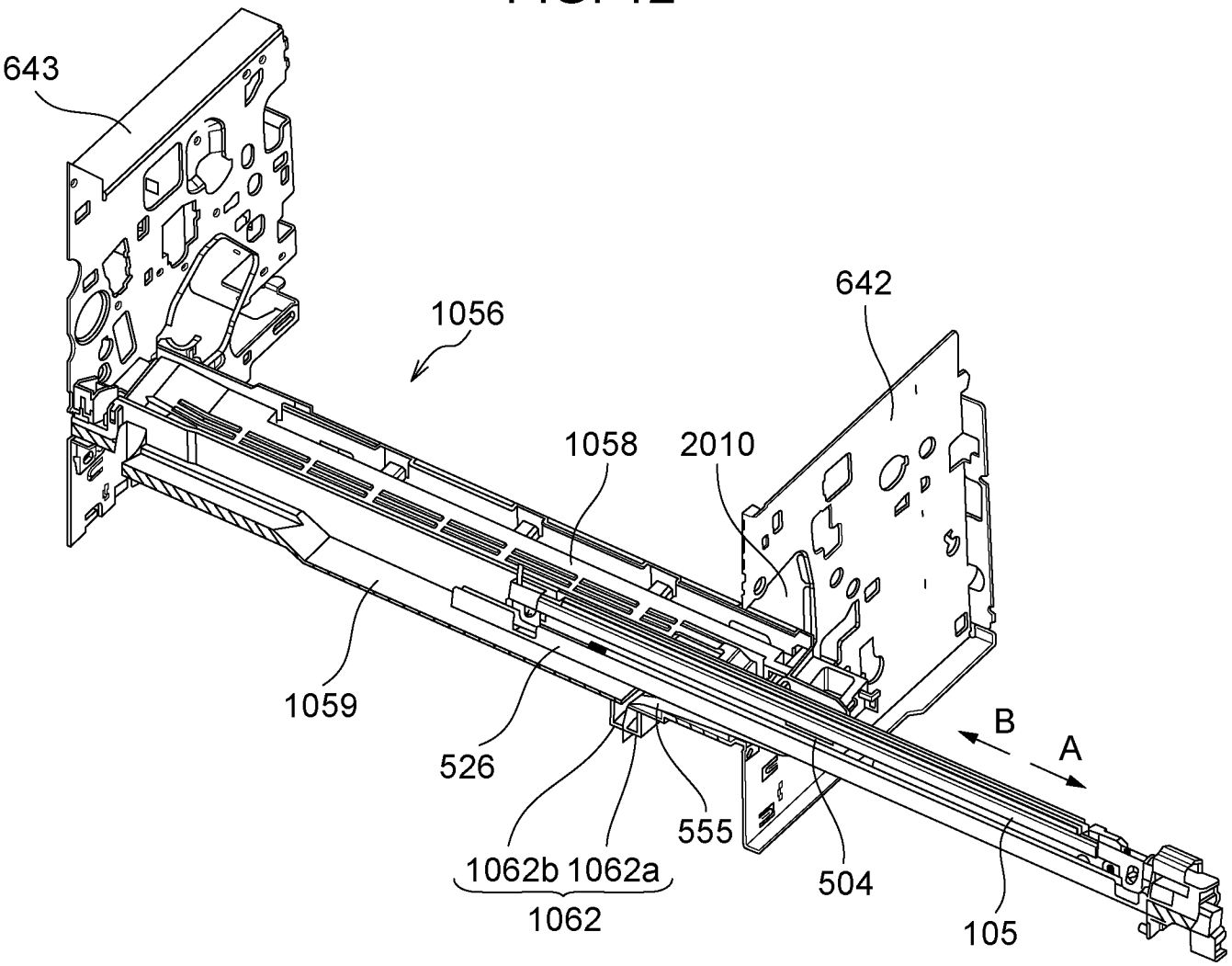
FIG. 12 is a diagram for describing the first support member and a second support member.

Mounting/Detaching Configuration of Optical Print Head as to Image Forming Apparatus Main Body FIG. 12 is a diagram for describing a state where the first support portion 526 has been drawn out from the main body of the image forming apparatus 1 along with the optical print head 105, by a worker such as a user, service staff, or the like. The first support portion 526 can be drawn out from the main body of the image forming apparatus 1 by sliding movement in the rotational axis direction of the photosensitive drum 103, as illustrated in FIG. 12. When the worker draws the first support portion 526 out from the main body of the image forming apparatus 1, the worker moves the first support portion 526 in the direction of the arrow A. On the other hand, when the worker mounts the first support portion 526 to the main body of the image forming apparatus 1, the worker moves the first support portion 526 in the direction of the arrow B. Note that the "direction of arrow A" matches the "direction of drawing out" the first support portion 526 from the main body of the image forming apparatus 1. The first support portion 526 moves in the direction of the arrow A and the direction of the arrow B via an opening 2010 formed in the front-side plate 642. Now, a position where the first support portion 526 has been mounted to the main body of the image forming apparatus 1 in order to perform exposure of the photosensitive drum 103 will be defined as a mounted position, and a position where the first support portion 526 moves in the direction of the arrow A from the mounted position so that the connector 504 is situated at the downstream side from the opening 2010 in the direction of the arrow A will be defined as a drawn-out position. In a case where there is a need to remove the optical print head 105 from the main body of the image forming apparatus 1 in order to replace the circuit board 502 or the like, the worker moves the first support portion 526 to the drawn-out position, and operates the connector 504 to remove the cable 555 from the connector 504. Thereafter, the first support portion 526 is further drawn out in the direction of the arrow A, whereby the first support portion 526 and optical print head 105 can be removed from the main body of the image forming apparatus 1.

Next, a second support portion 1056 (an example of a guide portion) will be described with reference to FIG. 12.

One end side of the second support portion 1056 (the front side of the main body of the image forming apparatus 1) is fixed to the front-side plate 642 by screws or the like. The other end side of the second support portion 1056 (the rear side of the main body of the image forming apparatus 1) is fixed to the rear-side plate 643 by screws or the like. The second support portion 1056 has a function of guiding movement of the first support portion 526 inserted into the main body of the image forming apparatus 1 from outside of the main body of the image forming apparatus 1 via the opening 2010 formed on the front-side plate 642. In other words, the second support portion 1056 has a function of guiding movement of the first support portion 526 moving from the drawn-out position toward the mounted position or from the mounted position toward the drawn-out position. The first support portion 526 is supported from beneath in the vertical direction by the second support portion 1056 while partway through being moved from the drawn-out position (or mounted position) toward the mounted position (or drawn-out position) by a worker. Now, the first support portion 526 at the mounted position is positioned and supported only by the front-side plate 642 and rear-side plate 643 in the present embodiment. Accordingly, the first support portion 526 at the mounted position is not supported by the second support portion 1056. The reason thereof is for the first support portion 526 to be positioned as to the photosensitive drum 103 with higher accuracy. If the first support portion 526 is positioned as to the second support portion 1056 fixed to the front-side plate 642 and rear-side plate 643, the first support portion 526 will be positioned by the front-side plate 642 and rear-side plate 643 with one extra member (the second support portion 1056 in this case) therebetween. Note that the second support portion 1056 is disposed within the main body of the image forming apparatus 1 for each of the four image forming units 102Y, 102M, 102C, and 102K. However, part of the first support portion 526 may be in contact with the second support portion 1056 when in a positioned state in the apparatus main body of the image forming apparatus 1 with the optical print head 105 in the mounted position.

Further, the second support portion 1056 has a guide portion 1058 and a guide portion 1059, as illustrated in FIG. 12. The guide portion 1058 has a function of guiding movement of the drum unit 518 (see FIGS. 2A and 2B) inserted through the opening 2010 of the front-side plate 642 toward the inside of the main body of the image forming apparatus 1. The shape of the guide portion 1058 corresponds to that of the lower portion of the drum unit 518. Accordingly, the drum unit 518 inserted from the front side of the main body of the image forming apparatus 1 through the opening 2010 of the front-side plate 642 toward the rear side fits to the guide portion 1058 with a slight amount of play. The worker further pushes the drum unit 518 in from the front side of the main body of the image forming apparatus 1 toward the rear side, in the state where the lower portion of the drum unit 518 is fit to the guide portion 1058. The drum unit 518 thus moves along the guide portion 1058 from the front side of the main body of the image forming apparatus 1 toward the rear side, and is mounted to the main body of the image forming apparatus 1.

On the other hand, the guide portion 1059 has a function of guiding movement of the optical print head 105 inserted through the opening 2010 of the front-side plate 642 toward the inside of the main body of the image forming apparatus 1. In a case where there is operation failure or the like of the circuit board 502, the optical print head 105 may be exchanged or repaired in maintenance. Accordingly, the optical print head 105 may have a configuration allowing replacement thereof in the image forming apparatus 1.

The shape of the guide portion 1059 corresponds to that of the lower portion of the first support portion 526. Accordingly, the first support portion 526 inserted from the front side of the main body of the image forming apparatus 1 through the opening 2010 of the front-side plate 642 toward the rear side fits to the guide portion 1059 with a slight amount of play. The first support portion 526 is further pushed in from the front side of the main body of the image forming apparatus 1 toward the rear side by the worker, in the state where the lower portion of the first support portion 526 is fit to the guide portion 1059. The first support portion 526 thus moves along the guide portion 1059 from the front side of the main body of the image forming apparatus 1 toward the rear side, and fits to an opening that is omitted from illustration, formed in the rear-side plate 643 at the rear side end of the first support portion 526. That is to say, the first support portion 526 can be positioned to the main body of the image forming apparatus 1 in a sure manner, by the worker moving the optical print head 105 from the front side of the main body of the image forming apparatus 1 toward the rear side in a state of being fit to the guide portion 1059.

Next, the functions of a restricting portion 1062 (an example of a holding portion) provided to the lower side of the second support portion 1056 will be described. The restricting portion 1062 has a first wall portion 1062*a* and a second wall portion 1062*b*, as illustrated in FIG. 12. The first wall portion 1062*a* is a member that holds the cable 555, laid from above the second support portion 1056 toward the lower side of the second support portion 1056 via a hole 1056*a*, by nipping the front side and rear side of the cable 555 between the first wall portion 1062*a* and second wall portion 1062*b*. Thus restricting portion 1062 is provided at the downstream side from a later-described protruding portion 662 in the direction in which the first support portion 526 is drawn out, in a state where the first support portion 526 is at the mounted position. The cable 555 is in a state attached to the second support portion 1056 by being nipped between the first wall portion 1062*a* and second wall portion 1062*b*. The first wall portion 1062*a* has elasticity, and the tip (the portion that comes into contact with the cable 555) side thereof is constantly pressed against the second wall portion 1062*b*. Accordingly, the cable 555 is nipped between the first wall portion 1062*a* and second wall portion 1062*b* in the rotational axis direction of the photosensitive drum 103, and movement from the front side of the image forming apparatus 1 toward the rear side, and movement from the rear side of the image forming apparatus 1 toward the front side, is restricted. Note that the configuration of the restricting portion 1062 is not restricted to a configuration such as described above, and may be of a configuration where the second wall portion 1062*b* has elasticity, i.e., a configuration where the second wall portion 1062*b* is pressed against the first wall portion 1062*a*, or a configuration where both are pressed against each other. Also, a configuration may be made where the second wall portion 1062*b* is omitted, for example, and the first wall portion 1062*a* is pressed against the lower side of the second support portion 1056. In this case, the cable 555 is attached to the second support portion 1056 by being nipped between the first wall portion 1062*a* and second support portion 1056 in the vertical direction. The cable 555 in the present embodiment is nipped between the first wall portion 1062*a* and second wall portion 1062*b*, but is configured to move in the nipped state. It is sufficient for the functions of the restricting portion 1062 to be such that movement of part of the cable 555 from the rear side of the image forming apparatus 1 toward the front side is restricted. Accordingly, the cable 555 may be fixed to the restricting portion 1062 by adhesive agent, double-sided adhesive tape, or the like, with slight movement (several centimeters) allowed.

The restricting portion 1062 does not have to be provided to the second support portion 1056. It is sufficient for the restricting portion 1062 to be disposed further to the rear side of the image forming apparatus 1 from the front-side plate 642 and further to the front side of the image forming apparatus 1 from the rear-side plate 643. Examples of positions where the restricting portion 1062 can be disposed include the rear side of the front-side plate 642 and the front side of the rear-side plate 643, for example. In a case of placing a relay board connected to the other end side of the cable 555 further to the rear side of the image forming apparatus 1 from the rear-side plate 643, the cable 555 extending from the relay board passes through a hole formed in the rear-side plate 643 and is laid at the front side from the rear-side plate 643. Note that the relay board mentioned here has functions of relaying drive signals sent from the control unit to the circuit board 502 in order to control drive voltage for driving the LEDs 503. The other end of the cable 555 may be directly connected to the control unit that is omitted from illustration, instead of the relay board. The cable 555 extending toward the front side from the hole formed in the rear-side plate 643 is connected to the connector 504 of the circuit board 502 via the hole 1056*a* formed in the second support portion 1056.

Figure 13:
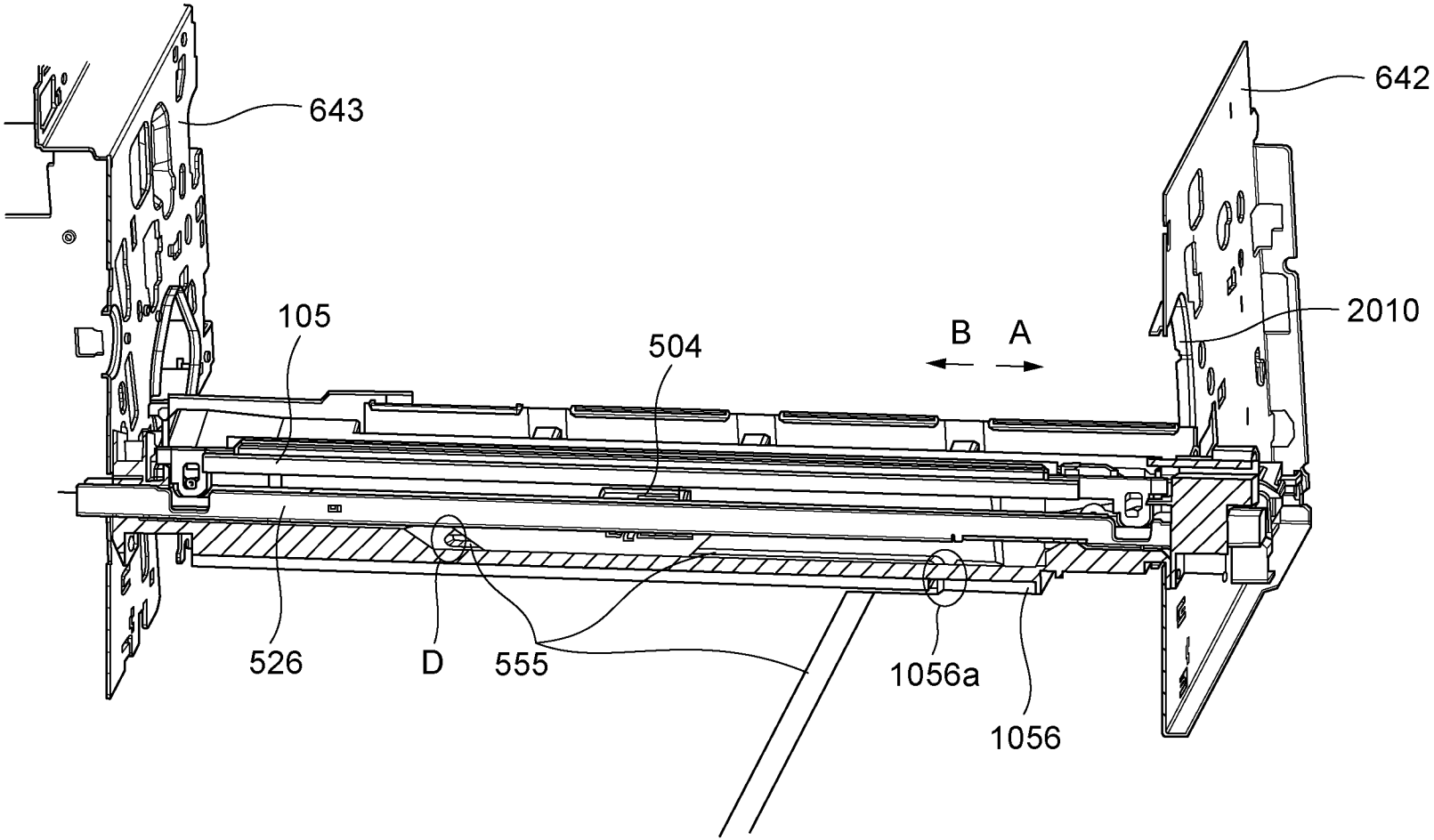
FIG. 13 is a diagram for describing the first support member situated at a mounted position.

FIG. 13 is a schematic perspective view illustrating a state where the first support portion 526 is at the mounted position. The restricting portion 1062 is omitted from illustration. Note that the cable 555, electrically connected to the control unit that is omitted from illustration and the connector 504, is passed through the hole 1056*a* formed in the second support portion 1056. The hole 1056*a* will be described in detail later. Routing of the cable 555 will be described with reference to FIG. 13. The cable 555 connected to the connector 504 passes through the opening 161 that is omitted from illustration in FIG. 13 formed in the first support portion 526, and extends downwards in the vertical direction from the connector 504. The cable 555 further extends from the opening 161 that is omitted from illustration in FIG. 13 toward the rear side of the image forming apparatus 1 following the longitudinal direction of the first support portion 526 (rotational axis direction of the photosensitive drum 103), and is folded back at a portion shown in a region D. Accordingly, one region of the cable 555 is curved, and a curved region (region D) is formed in the cable 555. The cable 555 that has been folded back at the region D extends following the guide portion 1059 of the second support portion 1056, toward the restricting portion 1062 formed to the front side of the second support portion 1056. The cable 555 is in contact with the first support portion 526 and the guide portion 1059 of the second support portion 1056 at the region D that is the curved region where the cable 555 is curved (hereinafter referred to as "curved portion D (one region of the cable)" formed in the cable 555).

Figure 14:
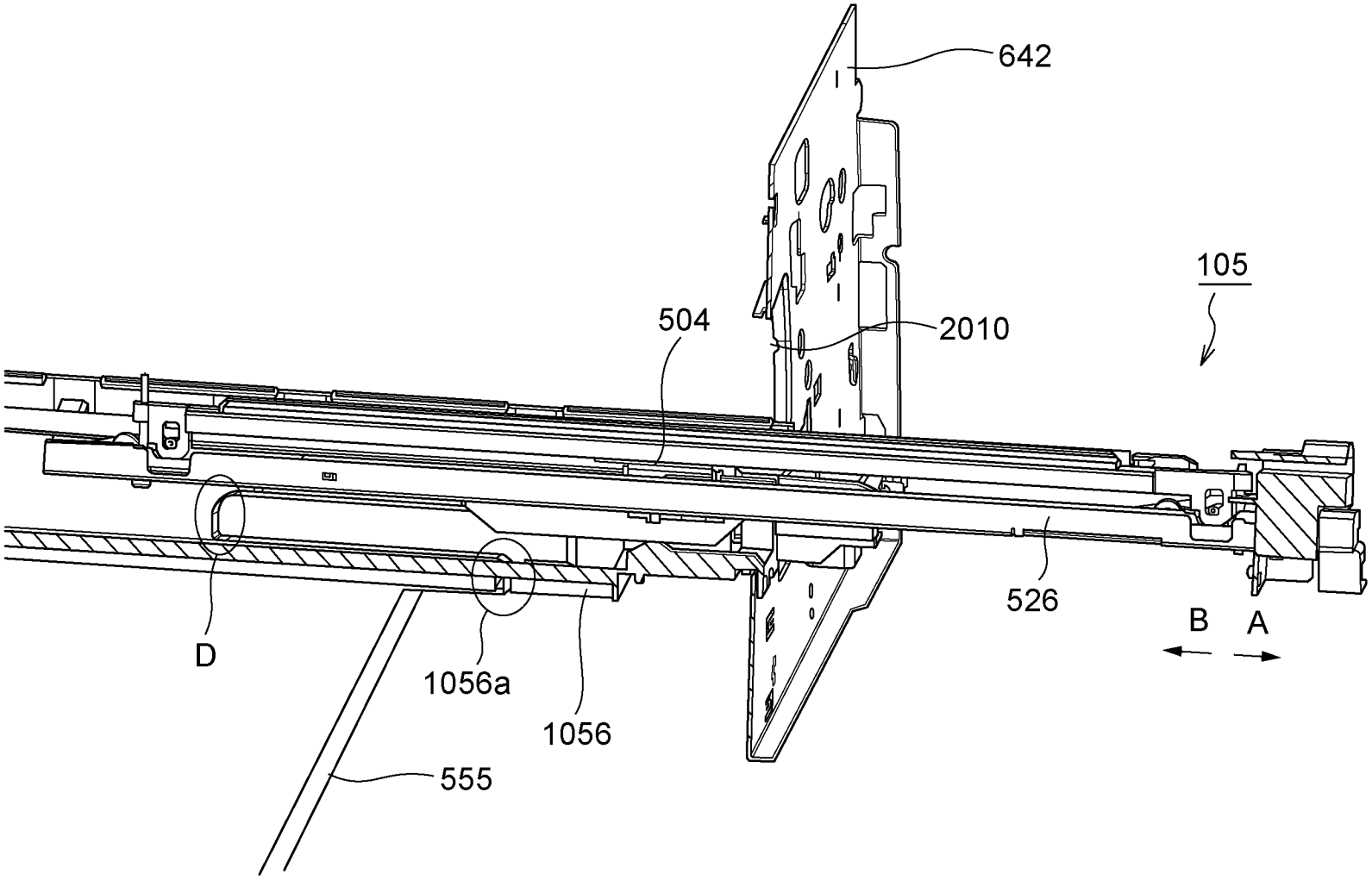
FIG. 14 is a diagram for describing the first support member being moved from the mounted position toward an extracting position.

FIG. 14 is a diagram for describing a state of the first support portion 526 moving from the mounted position to the drawn-out position. The restricting portion 1062 in FIG. 12 has been omitted from illustration in FIG. 14, to simplify description here. The curved portion D formed in the cable 555 moves in the direction of the arrow A, along with the first support portion 526 that moves in the direction of the arrow A, as illustrated in FIG. 14. The movement of the cable 555 is restricted by the restricting portion 1062 that is omitted from illustration in FIG. 14. That is to say, the cable 555 is flexed as illustrated in region D in FIG. 14, and accordingly the first support portion 526 can be drawn out in the direction of the arrow A. The curved portion D formed in the cable 555 curves toward the rear side of the image forming apparatus 1 in the rotational axis direction of the photosensitive drum 103. A worker further moves the first support portion 526 in the direction of the arrow A from the state illustrated in FIG. 14, so as to be moved to the drawn-out position.

Figure 15:
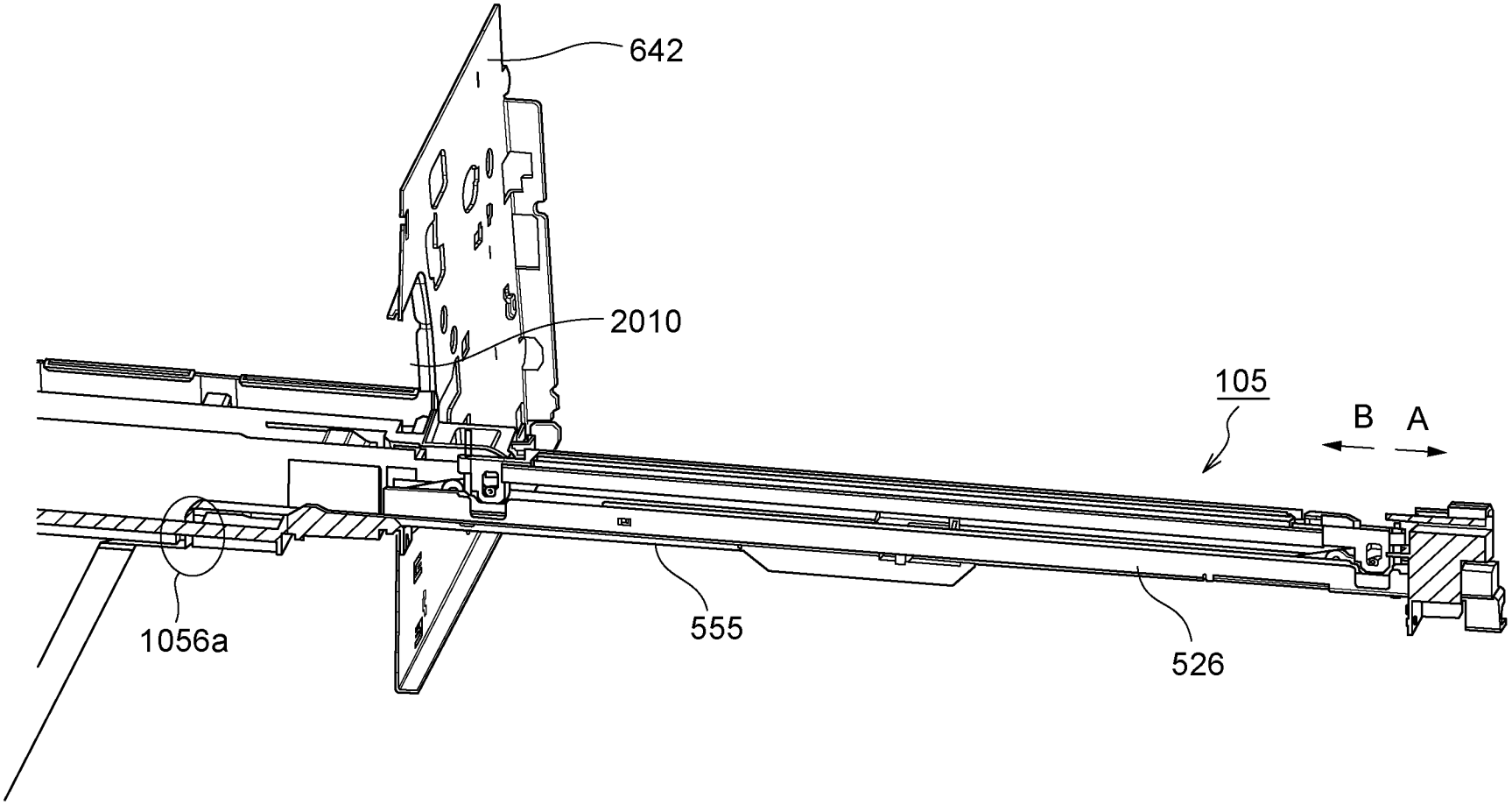
FIG. 15 is a diagram for describing the first support member situated at the extracting position.

FIG. 15 is a diagram illustrating a state where the first support portion 526 has moved to the drawn-out position. When the first support portion 526 is at the drawn-out position, the connector 504 is situated at the front side from the opening 2010 of the front-side plate 642, as illustrated in FIG. 15. The worker removes the cable 555 from the connector 504 in this state, and thereafter further draws the first support portion 526 out in the direction of the arrow A, and thus can remove the first support portion 526 and optical print head 105 from the image forming apparatus 1. When the first support portion 526 is situated at the drawn-out position, the cable 555 is in contact with the edge of the hole 1056*a* and is bent.

Figure 16A:
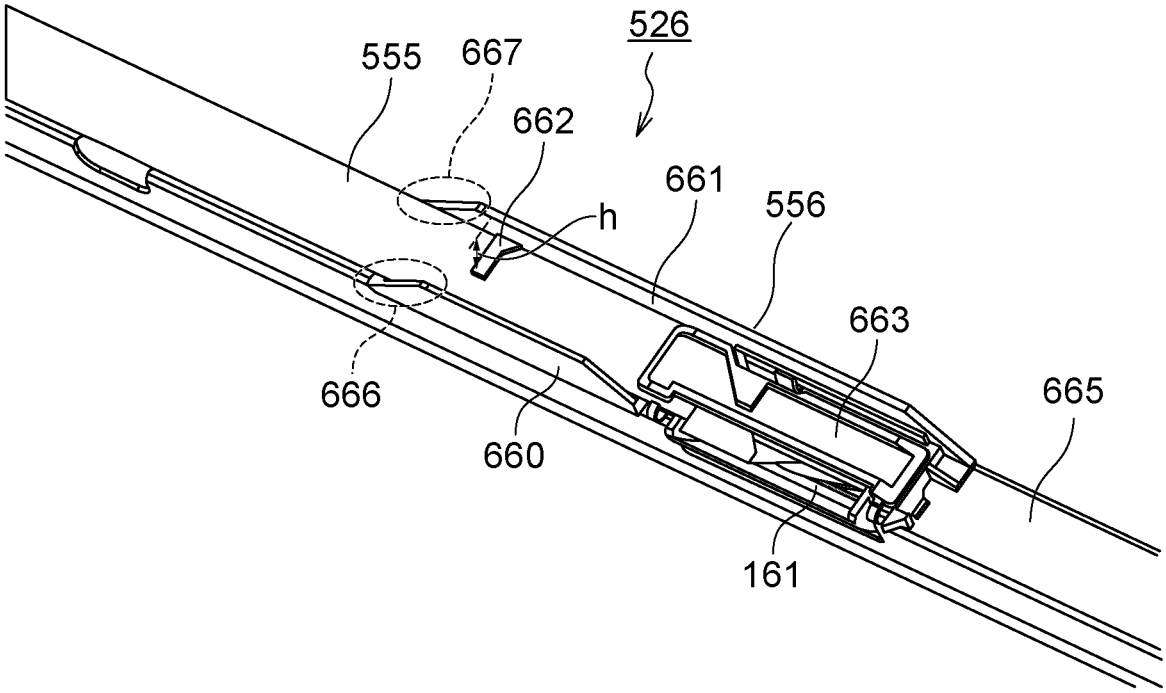
FIGS. 16A and 16B are for diagrams describing a cable guide member provided to the first support member.
Figure 16B:
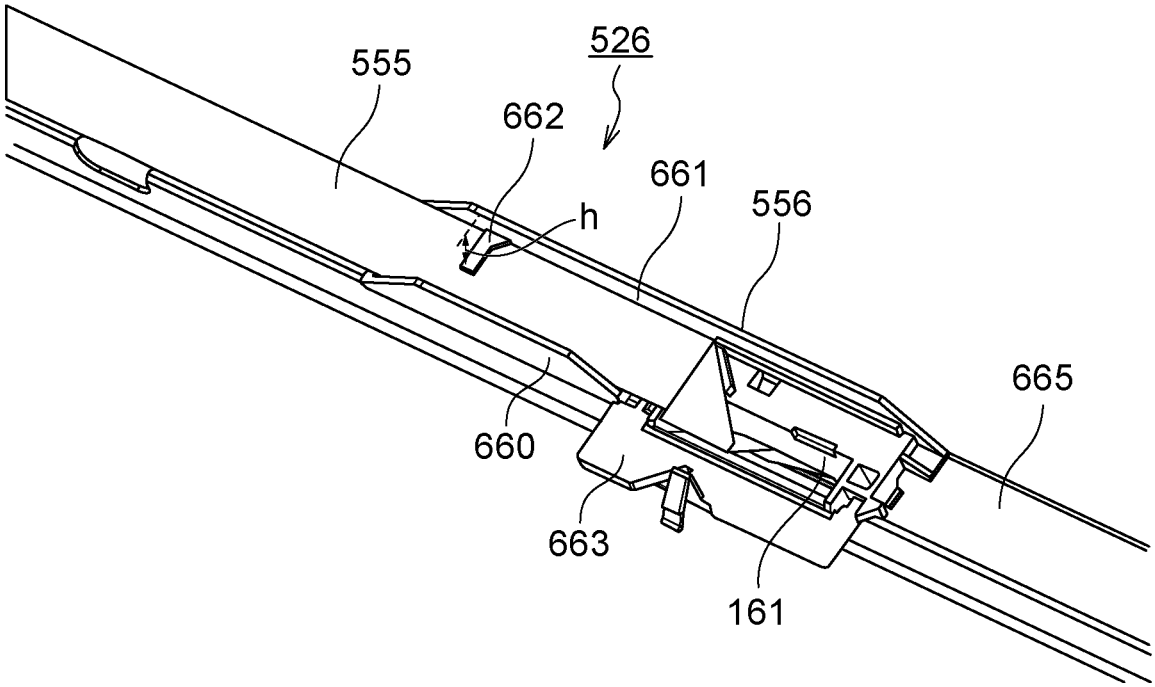

FIGS. 16A and 16B are diagrams for describing a cable guide portion 556 provided on the edge of the opening 161 of the first support portion 526. The cable guide portion 556 is attached by a snap-fit structure to the opening 161 formed in a bottom face portion 665 of the first support portion 526. The cable guide portion 556 has a first wall portion 660, a second wall portion 661, a protruding portion 662, and a cover 663 (an example of an abutting portion), as illustrated in FIG. 16A. FIG. 16B is a diagram illustrating a state in which the cover 663 of the cable guide portion 556 is open. The cable 555 that extends from the opening 161 to the lower side of the first support portion 526 is bent back at the portion of the opening 161, as illustrated in FIG. 16B. The cable 555 that has been bent back extends toward one end side or the other end side of the first support portion 526 in the direction of sliding movement of the sliding portion 525 omitted from illustration in FIGS. 16A and 16B. Note that the cable 555 in the present embodiment is routed from the opening 161 to the other end side of the first support portion 526 (the rear side of the image forming apparatus 1) in the direction of sliding movement of the sliding portion 525 omitted from illustration in FIGS. 16A and 16B. The portion of the cable 555 that has been bent is supported upwards in the vertical direction by the closed cover 663, as illustrated in FIG. 16A. In other words, the cover 663 is in contact with the bent portion of the cable 555 in the direction of the optical print head 105 moving from the retracted position to the exposing position.

The cable in the present embodiment is nipped between the closed cover 663 and the first support portion 526. The cable 555 nipped between the cover 663 and the first support portion 526 is routed toward the opposite direction of the direction of drawing out the first support portion 526 (direction toward the rear side of the image forming apparatus 1), along the longitudinal direction of the first support portion 526.

Figure 17A:
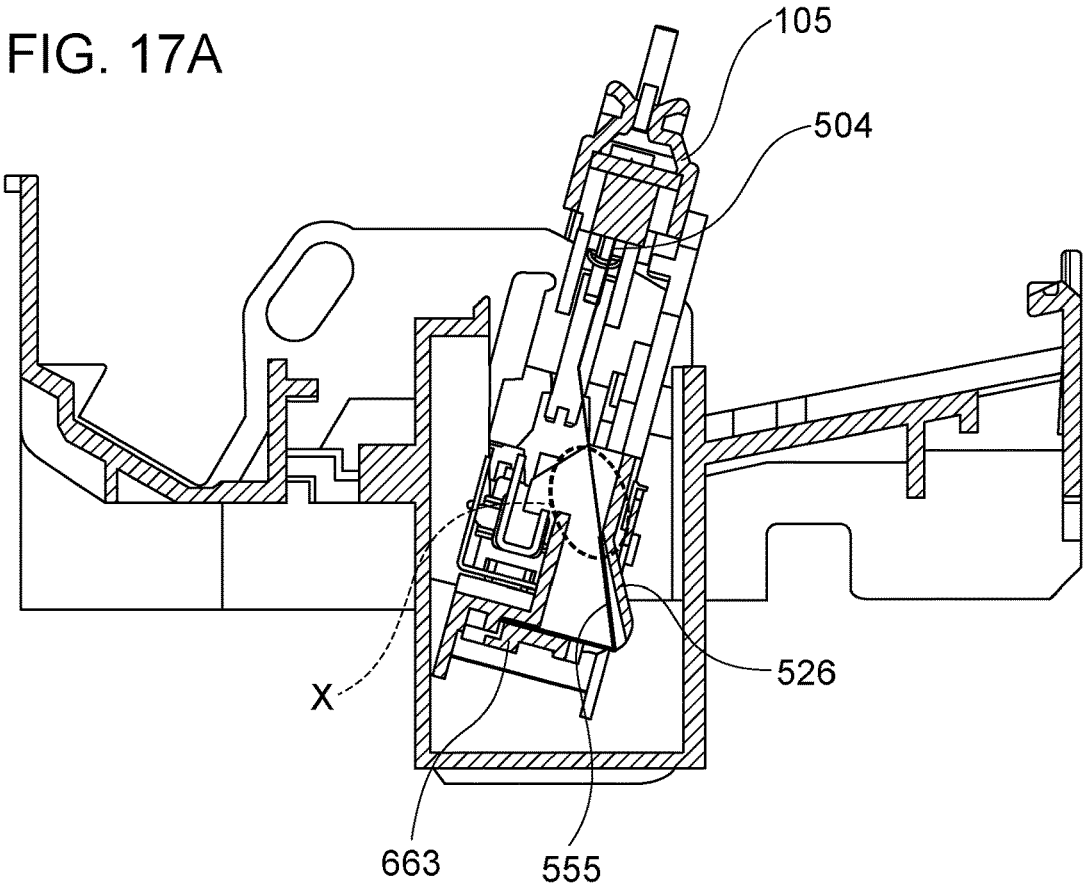
FIGS. 17A and 17B are diagrams for describing states of the cable in conjunction with movement of the optical print head.
Figure 17B:
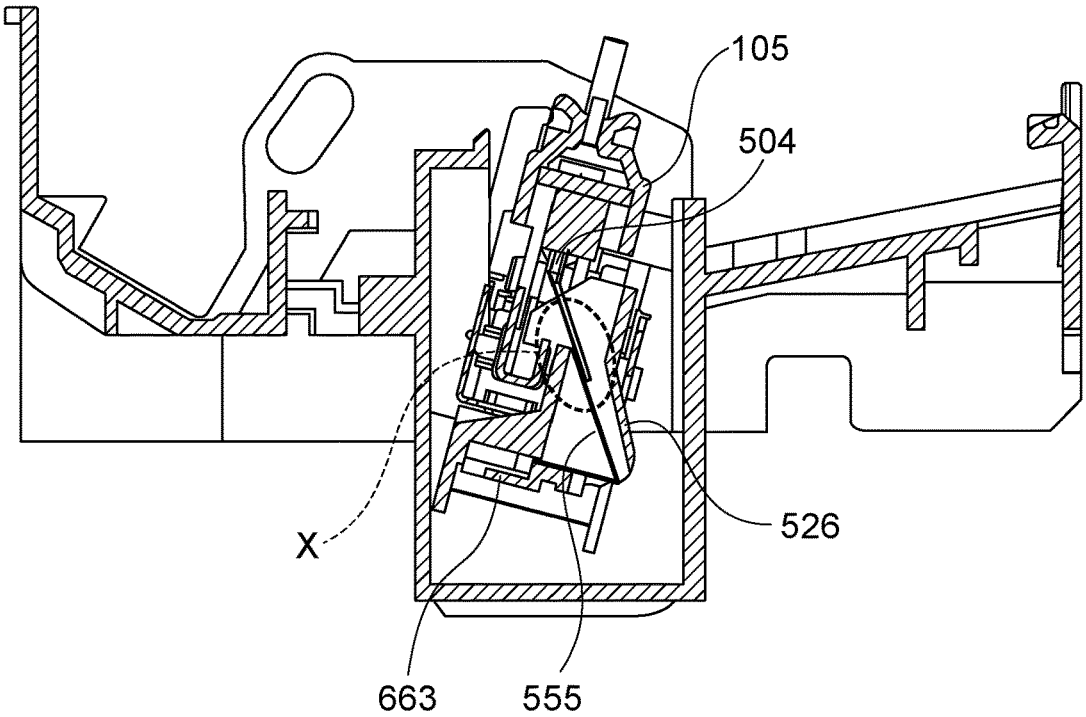

FIGS. 17A and 17B are cross-sectional views of the exposing unit 500 taken in a direction perpendicular to the rotational axis direction of the photosensitive drum 103. FIG. 17A illustrates a state where the optical print head 105 is at the exposing position, and FIG. 17B illustrates a state where the optical print head 105 is at the retracted position.

In FIGS. 17A and 17B, the region indicated by a dashed line X indicates a region of the cable 555 between a portion connected to the connector 504 and a portion bent in contact with the cover 663. The cable 555 is not flexed in the portion indicated by the dashed line X when the optical print head 105 is situated at the exposing position, as illustrated in FIG. 17A. On the other hand, the cable 555 is flexed (or bent) in the portion indicated by the dashed line X when the optical print head 105 is situated at the retracted position, as illustrated in FIG. 17B. This is because the cable 555 extending from the connector 504 is supported by the cover 663 in a state of being in contact with the cover 663. Although the portion of the cable 555 indicated by the dashed line X moves in the vertical direction in conjunction with the optical print head 105 moving between the exposing position and the retracted position, the cable 555 is received by the cover 663, as illustrated in FIG. 17B. The portion of the cable 555 encircled by the dashed line X bends between the connector 504 and the cover 663, and accordingly does not protrude to the lower side of the cable guide portion 556 in the vertical direction.

Now, a configuration where the cable guide portion 556 does not have the cover 663 will be assumed. In this case, when the optical print head 105 moves from the exposing position toward the retracted position as illustrated in FIG. 17B, the cable 555 is not supported by the cover 663, so no flexed portion is formed on the cable 555 such as indicated by the dashed line X, and the cable 555 is exposed downwards in the vertical direction from the opening 161 of the first support portion 526. If a worker happens to perform insertion/extraction of the first support portion 526 via the opening 2010 of the front-side plate 642 in this state, the cable 555 exposed downwards in the vertical direction from the opening 161 of the first support portion 526 may come into contact with the edge of the opening 2010 of the front-side plate 642. Providing the cover 663 as in the configuration of the present disclosure allows contact and damage of the cable 555 at the edge of the opening 2010 of the front-side plate 642 to be reduced.

The first wall portion 660 and second wall portion 661 of the cable guide portion 556 each protrude in a perpendicular direction from the bottom face portion 665 of the first support portion 526. The protruding portion 662 is formed on the second wall portion 661 extending in a direction that is perpendicular to both the protruding direction of the second wall portion 661 and the longitudinal direction of the first support portion 526 (perpendicular direction). That is to say, the positional relation of each of the first wall portion 660, second wall portion 661, and protruding portion 662, is that in a perpendicular direction perpendicular to both of the vertical direction and the rotational axis direction of the photosensitive drum 103, the first wall portion 660 is at a position on one side of the protruding portion 662, and the second wall portion 661 is situated on the other side of the protruding portion 662. The protruding portion 662 is fixed to the first support portion 526 upstream from the opening 161 in the direction of drawing out the first support portion 526 (direction of arrow A). The cable 555 that is exposed from the opening 161 and is nipped between the cover 663 and the bottom face portion 665 of the first support portion 526 is routed between the first wall portion 660 and the second wall portion 661. The first wall portion 660 and second wall portion 661 both overlap the cable 555 in a direction perpendicular to the direction in which the protruding portion 662 extends. The protruding portion 662 also is provided to the second wall portion 661 so as to be below the cable 555 routed between the first wall portion 660 and second wall portion 661. That is to say, the cable 555 is supported by the protruding portion 662 from beneath in the vertical direction. In other words, the cable 555 is routed between the protruding portion 662 and the bottom face portion 665 of the first support portion 526 in the vertical direction. Note that the protruding portion 662 may be provided to the first wall portion 660 instead of the second wall portion 661. In this case, the protruding portion 662 is a protrusion protruding from the first wall portion 660 toward the second wall portion 661. The protruding portion 662 may also link the first wall portion 660 and second wall portion 661. That is to say, the protruding portion 662 may be a member that connects the first wall portion 660 and second wall portion 661 in a perpendicular direction perpendicular to both the rotational axis direction of the photosensitive drum 103 and the vertical direction.

According to the above configuration, the cable 555 is routed from the opening 161 toward the rear side of the image forming apparatus 1, due to part of the cable 555 being supported by the protruding portion 662 upstream from the opening 161 in the direction of the first support portion 526 being drawn out.

Also, the first wall portion 660 and second wall portion 661 protrude downwards in the vertical direction by a distance h from the protruding portion 662, as indicated by the arrow h in FIGS. 16A and 16B. The distance h is 5 mm in the present embodiment. This configuration can prevent the cable 555 from being caught between the protruding portion 662 and the lower-side edge of the opening 2010 formed in the front-side plate 642, when the first support portion 526 is moved from the drawn-out position toward the mounted position, which will be described in detail later.

Further, an inclined face 666 is formed at the front side edge portion of the first wall portion 660, and an inclined face 667 is formed at the front side edge portion of the second wall portion 661, as illustrated in FIG. 16A. The inclined face 666 and inclined face 667 are inclined toward the bottom face portion 665 of the first support portion 526 in accordance with the direction opposite to the direction of the first support portion 526 being drawn out from the image forming apparatus 1. The angle of incline of the inclined face 666 as to the bottom face portion 665 and the angle of incline of the inclined face 667 as to the bottom face portion 665 each is 10 degrees or more but 40 degrees or less in the present embodiment. When the first support portion 526 passes through the opening 2010 from the drawn-out position toward the mounted position, the inclined face 666 and inclined face 667 abut the lower-side edge in the vertical direction of the opening 2010. Thus, movement of the first support portion 526 is guided by the inclined face 666 and inclined face 667. Accordingly, the worker can easily pass the first support portion 526 through the opening 2010 and move the first support portion 526 from the drawn-out position toward the mounted position.

Next, the length of the cable 555 between the hole 1056*a* and the connector 504, and the distance between the hole 1056*a* and the opening 2010 of the front-side plate 642, in a state where the first support portion 526 is mounted within the main body of the image forming apparatus 1 (a state of being situated at the mounted position) will be described with reference to FIGS. 18A through 18C.

Figure 18A:
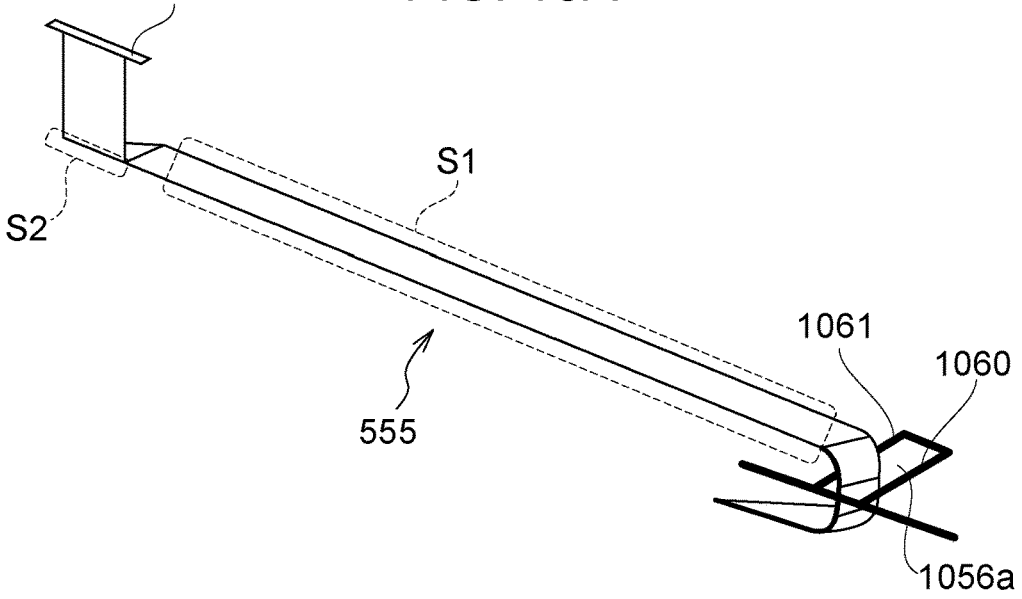
FIGS. 18A through 18C are diagrams for describing the cable.

FIG. 18A is a diagram for describing the cable 555 extending from the connector 504 to the hole 1056*a* formed in the second support portion 1056. It can be seen from FIG. 18A that the cable 555 extending upward from the hole 1056*a* is routed toward the connector 504. A region S1 of the cable 555 is routed following the first support portion 526 toward the front side of the image forming apparatus 1, and faces the lower face of the first support portion 526. Note that the cable 555 extending toward the connector 504 is illustrated as having a configuration bent upwards at a generally right angle at the portion illustrated in a region S2, to simplify description.

Figure 18B:
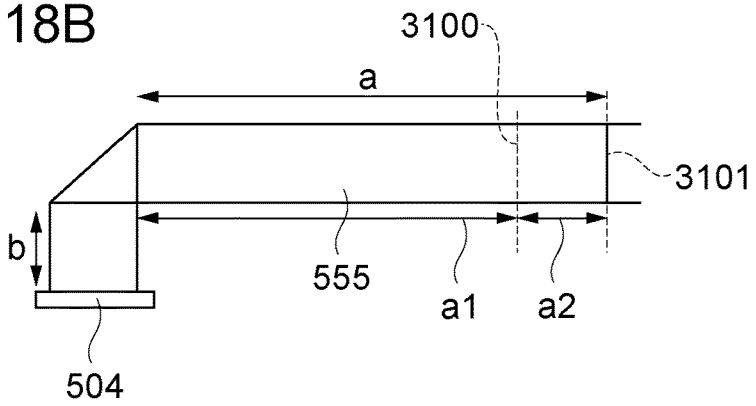

FIG. 18B illustrates a state where the bending (region S2) of the cable 555 illustrated in FIG. 18A has been undone and straightened. FIG. 18C is a cross-sectional view of the front side of the second support portion 1056 and the opening 2010 of the front-side plate 642, taken along the rotational axis direction of the photosensitive drum 103 in the vertical direction, in a state where the first support portion 526 is drawn out from the image forming apparatus 1. A portion in FIG. 18B indicated by a dotted line 3100 is a portion of the cable 555 that comes into contact with the edge of the hole 1056*a* (wall portion 1060 or wall portion 1061). A portion in FIG. 18B indicated by a dotted line 3101 is a portion of the cable 555 that comes into contact with the restricting portion 1062. The length of the portion indicated by arrow a in FIG. 18B indicates the length from the portion where the cable 555 extending downwards from the connector 504 is folded back toward the front side of the image forming apparatus 1, to the portion where the cable 555 comes into contact with the edge of the hole 1056*a* (wall portion 1060). The length of the portion indicated by arrow a2 in FIG. 18B indicates the length from the portion where the cable 555 comes into contact with the wall portion 1060 to the portion nipped by the restricting portion 1062. The length of the arrow b in FIG. 18B is the length from the portion connected to the connector 504 to the portion where the cable 555, extending downwards from the connector 504, is folded back toward the front side of the image forming apparatus 1. That is to say, the sum of the length of the cable 555 at the portion indicated by arrow a, which is the sum of arrow a1 and arrow b2, and the length of the cable 555 at the portion indicated by arrow b, is the shortest length of the cable 555 from the restricting portion 1062 to the connector 504.

Figure 18C:
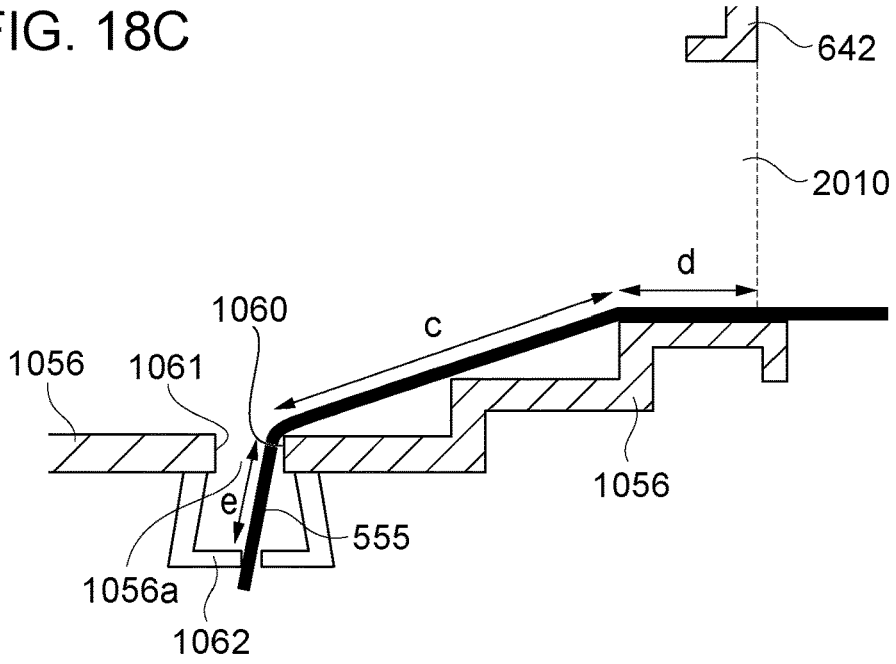

FIG. 18C illustrates a state where the cable 555 is folded back toward the front side of the image forming apparatus 1 with the wall portion 1060 of the hole 1056*a* as a fulcrum, due to the optical print head 105 having been drawn out from the image forming apparatus 1. In this state, the cable 555 is taut and is not flexed. Now, the sum of length c, length d, and length e, which is the length of the cable 555 from the hole 1056*a* to the opening 2010, is defined as the distance (shortest distance) between the hole 1056*a* and the opening 2010, as illustrated in FIG. 18C. This shortest distance can be found by pulling the connecting portion side (side connected to the connector 504) of the cable 555 toward the front side while in contact with the lower edge of the opening 2010, even if the upper face of the second support portion 1056 has a stepped shape such as illustrated in the example in FIG. 18C, for example. In other words, when the cable 555 is pulled from the rear side toward the front side, from the front side of the opening 2010 in a state where the cable 555 is nipped by the restricting portion 1062, until there is no slack left, the distance from the restricting portion 1062 to the opening 2010 is the "shortest distance". The length of the cable 555 from the restricting portion 1062 to the portion connected to the connector 504 is longer than the above-described "shortest distance", as illustrated in FIG. 12. That is to say, the length of the cable 555 from the restricting portion 1062 to the portion connected to the connector 504 in a state where the cable 555 is connected to the connector 504, is a length where the connector 504 is situated to the front side from the opening 2010 in a case where the optical print head 105 has been moved to the drawn-out position in a state with the cable 555 connected to the connector 504.

By employing such a configuration, the worker can draw out the first support portion 526 to a drawn-out position that is a position where at least part of the connector 504 is situated at the front side of the image forming apparatus 1 from the opening 2010 of the front-side plate 642. The worker moves the first support portion 526 to the drawn-out position and removes the cable 555 from the connector 504 that is situated to the front side from the opening 2010. Thereafter, the worker further draws the optical print head 105 out toward the front side of the image forming apparatus 1, and performs maintenance and the like of the optical print head 105.

Second Embodiment

Figure 19:
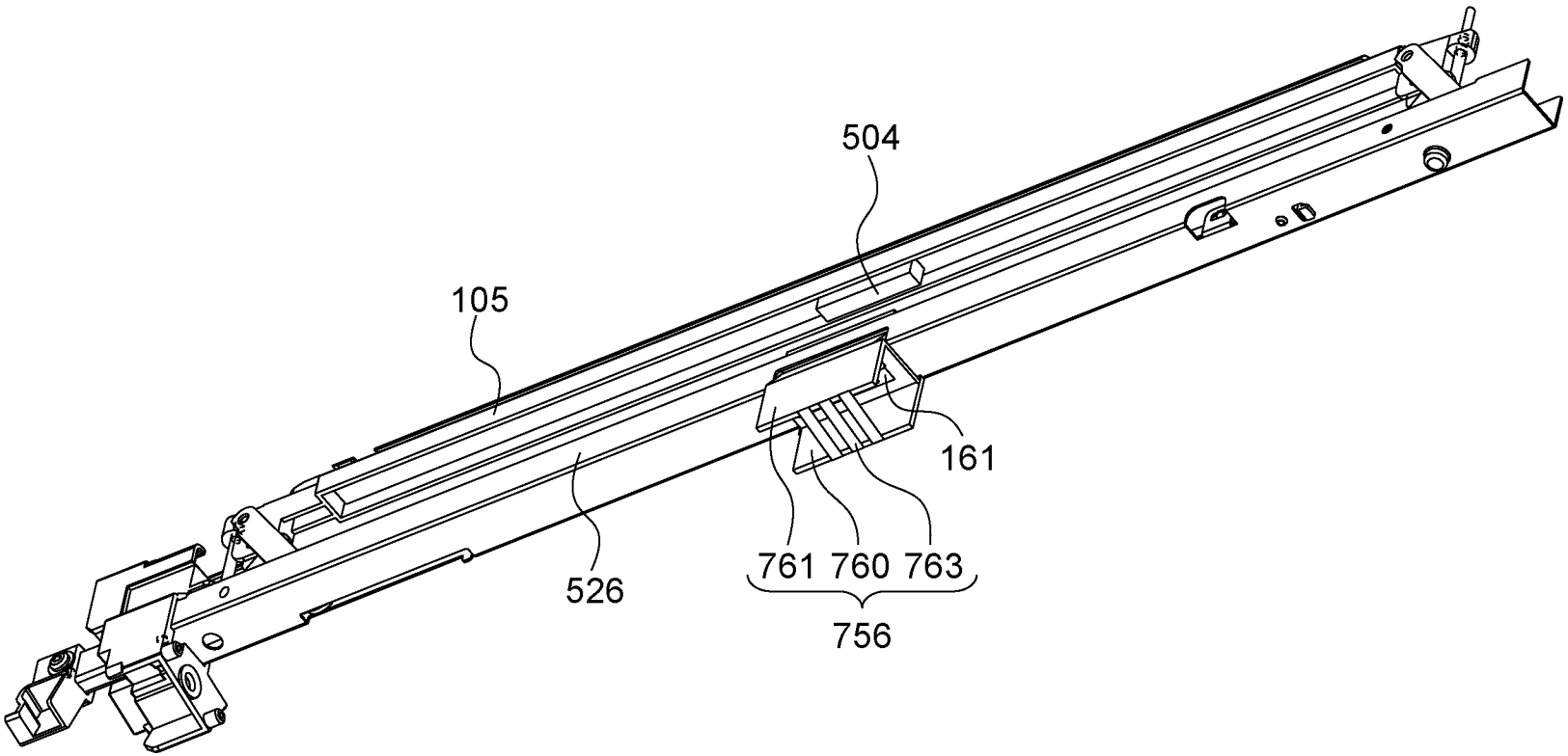
FIG. 19 is a diagram for describing a cable guide member according to a second embodiment.

FIG. 19 is a diagram for describing a cable guide member 756 according to a second embodiment. The cable guide member 756 has a first wall portion 760, a second wall portion 761, and a contact face portion 763 (an example of an abutting portion), as illustrated in FIG. 19. The first wall portion 760 is provided on the bottom face of the first support portion 526 so as to be on one side of the opening 161, in a perpendicular direction perpendicular to both of the rotational axis direction of the photosensitive drum 103 and the direction of movement of the optical print head 105 that is moved by the movement mechanism 640. The second wall portion 761 is provided on the bottom face of the first support portion 526 so as to be on the other side of the opening 161, in a perpendicular direction perpendicular to both of the rotational axis direction of the photosensitive drum 103 and the direction of movement of the optical print head 105 that is moved by the movement mechanism 640. In other words, the first wall portion 760 is provided to the right-side rim of the opening 161, and the second wall portion 761 is provided to the left-side rim of the opening 161. The first wall portion 760 and the second wall portion 761 both protrude downwards in the vertical direction from the first support portion 526.

The contact face portion 763 is provided between the first wall portion 760 and the second wall portion 761, so as to link the bottom faces of the first wall portion 760 and second wall portion 761, as illustrated in FIG. 19. Multiple contact face portions 763 are provided with intervals therebetween in the present embodiment, as illustrated in FIG. 19. Part of the cable 555 comes into contact with the contact face portion 763 when the optical print head 105 is moved from the exposing position toward the retracted position. This contact with part of the cable 555 causes the portion of the cable 555 between the connector 504 and the contact face portion 763 to bend and flex. Note that the cable 555 may be bent instead of being flexed. Accordingly, the cable 555 will not protrude downwards in the vertical direction from the cable guide member 756 even when the optical print head 105 is situated at the retracted position.

An arrangement may be made where the contact face portion 763 is omitted from the cable guide member 756. Note however, that in this case, the first wall portion 760 and second wall portion 761 should be protruding downwards in the vertical direction farther than the region of the cable 555 exposed downwards in the vertical direction from the opening 161 and folded back toward the rear side of the apparatus main body when the optical print head 105 is situated at the retracted position.

Figure 20A:
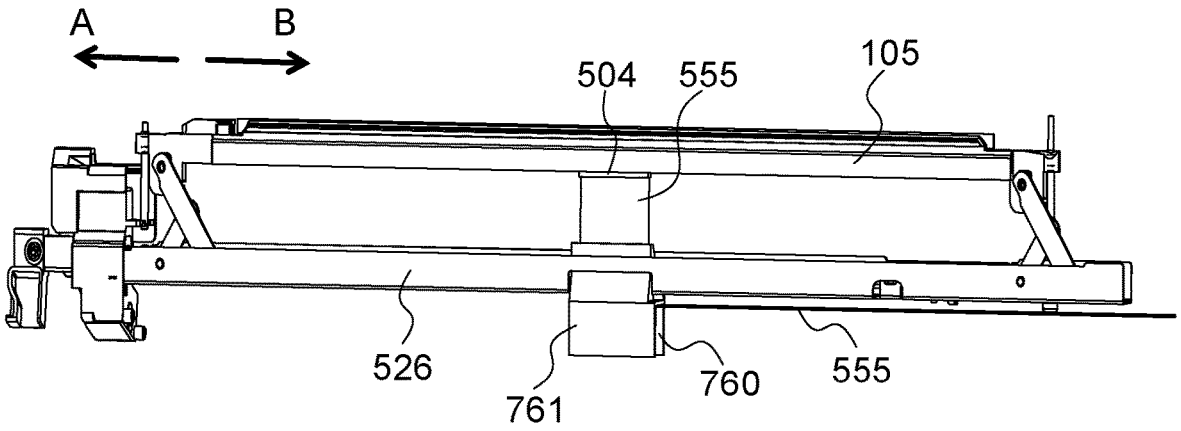
FIGS. 20A and 20B are diagrams for describing a cable guide member according to a modification.
Figure 20B:
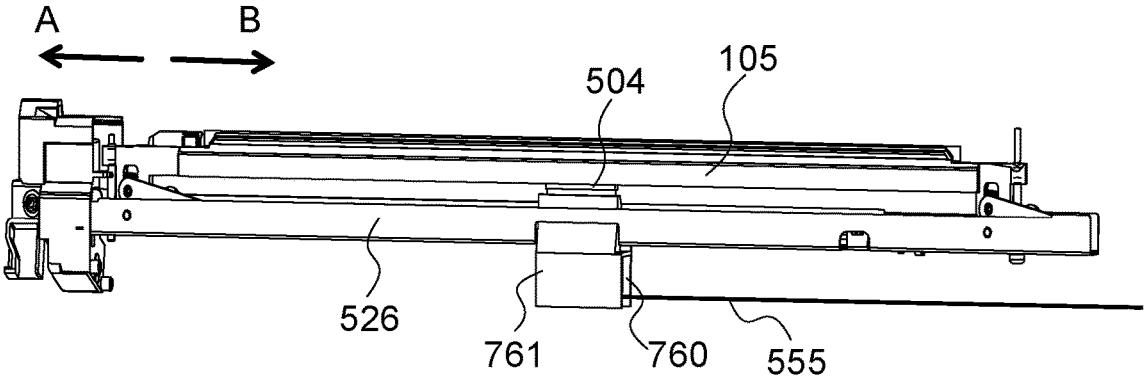

FIGS. 20A and 20B are diagrams for describing operations of the cable 555 in a case where the cable guide member 756 does not have the contact face portion 763 as described above. FIG. 20A illustrates a state where the optical print head 105 is at the exposing position, and FIG. 20B illustrates a state where the optical print head 105 is at the retracted position.

The cable 555 connected to the connector 504 extends downwards in the vertical direction from the connector 504, as illustrated in FIG. 20A. The cable 555 passes through the opening 161 formed in the first support portion 526, and is folded back and extends toward the rear side of the image forming apparatus 1 (direction of arrow B in FIG. 20A). The cable 555 has the shape thereof fixed by adhesive agent or the like, for example, in order to maintain the folded-back state. Accordingly, even in a case where the optical print head 105 is at the retracted position as illustrated in FIG. 20B, the cable 555 is not exposed downwards in the vertical direction from the first wall portion 760 and second wall portion 761 directly below the connector 504. Thus, the portion of the cable 555 situated directly below the connector 504 does not come into contact with the edge of the opening 2010 formed in the front-side plate 642, even in a case where the first support portion 526 is moved between the mounted position and the drawn-out position in a state where the optical print head 105 is at the retracted position. However, the cable 555 does not flex directly below the connector 504 when the optical print head 105 moves to the retracted position as in the first embodiment, so the size of this exposing unit is larger in the vertical direction as compared to the exposing unit in the first embodiment.

Although the above-described embodiments use four image forming units and optical print heads, the numbers used are not restrictive, and may be appropriately set as necessary.

Although a printer has been exemplified as the image forming apparatus in the above-described embodiments, the present disclosure is not restricted to this. The present disclosure may be applied to other image forming apparatuses such as photocopiers, facsimile devices, and so forth, or multi-function peripherals (MFP) where these functions are combined, thereby obtaining the same benefits.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-132659, filed Jul. 12, 2018, which is hereby incorporated by reference herein in its entirety.

What is claimed is:

1. An image forming apparatus comprising:

a photosensitive drum configured to rotate as to an apparatus main body;

a print head having a connector, and a light emitting element configured to emit light to expose the photosensitive drum to the emitted light;

a movement mechanism configured to move the print head in a direction between an exposing position where the light emitting element emits the light and exposes the photosensitive drum, and a retracted position where the print head is retracted to a position farther away from the photosensitive drum than the exposing position;

a support part configured to support the movement mechanism, wherein the support part is movable in a rotational axis direction of the photosensitive drum via an opening formed in a front-side plate provided to a front side of the apparatus main body, and wherein the support part is movable between a mounted position where the print head is mounted to the apparatus main body;

a drawn-out position configured be drawn out from the image forming apparatus and having the connector at a position exposed from the opening;

a cable configured to be connected to the connector and supply drive signals for driving the light emitting element to the print head, wherein the cable extends toward an opposite side of the connector from a side where the photosensitive drum is disposed, and is bent, at a bent portion, toward one direction or another direction of the support part in the rotational axis direction at an opposite side of the support part from the side where the photosensitive drum is disposed; and an abutting portion configured to be provided to the support part, and to abut the bent portion of the cable in a direction from the retracted position toward the exposing position to cause the cable to flex at a portion of the cable between a connected portion to the connector and the bent portion, in a case where the print head is situated at the retracted position.

2. The image forming apparatus according to claim 1, wherein the cable is a flexible flat cable.

3. The image forming apparatus according to claim 2, wherein, when the print head is situated at the retracted position, the portion of the cable between the connected portion to the connector and the bent portion flexes in the print head movement direction by being nipped between the connector and the abutting portion in the print head movement direction.

4. The image forming apparatus according to claim 1, wherein an opening is formed at a portion of the support part that faces the connector, and the cable passes through the support part opening and is connected to the connector.

5. The image forming apparatus according to claim 4, wherein the support part opening overlaps the connector in the print head movement direction that is moved between the exposing position and the retracted position by the movement mechanism.

6. The image forming apparatus according to claim 4, wherein the support part opening is formed on a bottom face portion that is a face on an opposite side of the support part from a side where the print head is disposed, wherein a first wall portion is formed protruding from the bottom face portion in an opposite direction from the side where the print head is disposed, in a perpendicular direction perpendicular to a direction of a sliding movement, at one side of the support part opening, and a second wall portion is formed protruding from the bottom face portion in the opposite direction from the side where the print head is disposed, in the perpendicular direction, at another side of the support part opening, and wherein the abutting portion is formed on the first wall portion or the second wall portion, to be situated between the first wall portion and the second wall portion.

7. The image forming apparatus according to claim 4, wherein the support part opening is formed on a bottom face portion that is a face on an opposite side of the support part from a side where the print head is disposed, wherein a first wall portion is formed protruding from the bottom face portion in an opposite direction from the side where the print head is disposed, in a perpendicular direction perpendicular to a direction of a sliding movement, at one side of the support part opening, and a second wall portion is formed protruding from the bottom face portion in the opposite direction from the side where the print head is disposed, in the perpendicular direction, at another side of the support part opening, and wherein, to link the first wall portion and the second wall portion, the abutting portion has one end side provided to the first wall portion and the other end side provided to the second wall portion.

8. The image forming apparatus according to claim 1, further comprising a rear-side plate configured to be disposed at a rear side of the apparatus main body, wherein, when the support part is situated at the mounted position, one end side of the support part in a direction of a sliding movement is fixed to the front-side plate and another end side of the support part in the sliding movement direction is fixed to the rear-side plate, wherein the opening formed in the front-side plate is a first opening, and wherein a second opening, through which the support part and the print head that move between the mounted position and the drawn-out position pass, is formed in the front-side plate.

9. The image forming apparatus according to claim 8, further comprising:

a guide portion configured to be fixed to the apparatus main body, to support the support part that performs the sliding movement between the mounted position and the drawn-out position, and to guide the support part that performs the sliding movement; and a holding portion configured to be disposed on the guide portion, and hold part of the cable to restrict part of the cable from moving in the sliding movement direction.

10. The image forming apparatus according to claim 9, wherein one end side of the guide portion in the sliding movement direction is fixed to the front-side plate, and another end side of the guide portion in the sliding movement direction is fixed to the rear-side plate.

11. The image forming apparatus according to claim 9, wherein, by nipping and holding part of the cable in a vertical direction or in the sliding movement direction, the holding portion restricts part of the cable from moving in the sliding movement direction.

12. The image forming apparatus according to claim 9, wherein a length of the cable from the holding portion to the connector when the support part is situated at the mounted position is longer than a distance from the second opening formed in the front-side plate to the connector when the support part is situated at the mounted position.

13. The image forming apparatus according to claim 9, wherein a length of the cable from the holding portion to the connector is longer than a length of the cable in a case where the holding portion and the second opening formed in the front-side plate are connected by the cable without slack.

14. An image forming apparatus comprising:

a photosensitive member;

an exposing unit that is elongated and is configured to expose the photosensitive member from below, wherein the exposing unit is provided with a circuit board arranged with light emitting elements, and wherein the light emitting elements are configured to emit light for exposing the photosensitive member and are arrayed along a longitudinal direction of the exposing unit;

a connector that is elongated and is provided on a bottom face of the circuit board such that the connector extends along the longitudinal direction of the exposing unit;

a flexible flat cable connected to the connector and configured to transmit drive signals for driving the light emitting elements, wherein the flexible flat cable extends downwards from the connector and is bent to extend along the longitudinal direction; and a supporting portion provided in contact with the exposing unit, wherein the supporting portion supports the flexible flat cable such that a surface of the flexible flat cable faces a bottom face of the exposing unit.

15. The image forming apparatus according to claim 14, wherein the supporting portion is positioned immediately below the connector.

16. The image forming apparatus according to claim 14, wherein the exposing unit includes:

a holder configured to hold the circuit board, wherein the holder includes a lens facing the light emitting elements and is configured to concentrate the light emitted from the light emitting elements to the photosensitive member, a movement mechanism configured to move the holder to an exposing position at which the photosensitive member is exposed, and to move the holder to a separation position that is farther away from the photosensitive member than the exposing position, and a movement mechanism supporting frame having a bottom face and configured to support the movement mechanism, wherein the movement mechanism supporting frame is formed with an opening where the flexible flat cable extending downwards from the connector passes through, and wherein the supporting portion is provided to the movement mechanism supporting frame at a position right below the opening.

17. The image forming apparatus according to claim 16, further comprising:

a front-side plate provided to a front side of the image forming apparatus and fixed to one end side of the movement mechanism supporting frame with respect to the longitudinal direction of the exposing unit; and a rear-side plate provided to a rear side of the image forming apparatus and fixed to the other one end side of the movement mechanism supporting frame with respect to the longitudinal direction.

18. The image forming apparatus according to claim 16, wherein the supporting portion clips the flexible flat cable on the bottom face of the movement mechanism supporting frame.

19. The image forming apparatus according to claim 16, wherein the flexible flat cable passes between the supporting portion and the bottom face of the movement mechanism supporting frame.

20. The image forming apparatus according to claim 16, wherein the supporting portion is configured to nip a portion of the flexible flat cable between the supporting portion and the bottom face of the movement mechanism supporting frame.

* * * * *